US008297184B2

(12) United States Patent
Numauchi

(10) Patent No.: US 8,297,184 B2
(45) Date of Patent: Oct. 30, 2012

(54) SYNCHRONOUS CONTROL METHOD AND APPARATUS FOR ROTARY STENCIL PRINTING PRESS

(75) Inventor: Hiromitsu Numauchi, Tsukuba (JP)

(73) Assignee: Komori Corporation

( * ) Notice: Subject to any disclaimer, the term of this patent is extended or adjusted under 35 U.S.C. 154(b) by 632 days.

(21) Appl. No.: 12/507,190

(22) Filed: Jul. 22, 2009

(65) Prior Publication Data

US 2010/0043655 A1 Feb. 25, 2010

(30) Foreign Application Priority Data

Aug. 22, 2008 (JP) ..... 2008-213525

(51) Int. Cl.
*B41M 1/12* (2006.01)
*B41F 5/00* (2006.01)

(52) U.S. Cl. ..... 101/129; 101/216; 101/484

(58) Field of Classification Search ..... 101/216, 101/218, 229, 230, 232, 116–120, 129, 483, 101/484, 485, 486
See application file for complete search history.

(56) References Cited

U.S. PATENT DOCUMENTS

| | | | | |
|---|---|---|---|---|
| 4,955,265 | A * | 9/1990 | Nakagawa et al. | 83/74 |
| 5,656,909 | A * | 8/1997 | Gotz et al. | 318/625 |
| 5,979,311 | A | 11/1999 | Kakurai et al. | |
| 6,382,093 | B1 * | 5/2002 | Hara | 101/116 |
| 2006/0102030 | A1 * | 5/2006 | Hirano | 101/350.1 |
| 2007/0022888 | A1 * | 2/2007 | Inde et al. | 101/365 |
| 2008/0092758 | A1 | 4/2008 | Numauchi et al. | |

FOREIGN PATENT DOCUMENTS

| | | | |
|---|---|---|---|
| CN | 1221681 | A | 7/1999 |
| CN | 101164778 | A | 4/2003 |
| EP | 0925953 | A1 | 6/1999 |
| EP | 1914072 | A2 | 4/2008 |
| JP | 2008-120064 | A | 5/2008 |

* cited by examiner

*Primary Examiner* — Ren Yan
(74) *Attorney, Agent, or Firm* — Birch, Stewart, Kolasch & Birch, LLP

(57) ABSTRACT

A synchronous control method and apparatus for a rotary stencil printing press individually drive a rotary screen cylinder by a dedicated drive motor, can set how many rotations have been made before arrival of a sheet at a screen printing unit when synchronous control of the drive motor with respect to a prime motor of a sheet-fed offset printing press is started, and stop the rotation of the rotary screen cylinder until the start of the synchronous control.

7 Claims, 21 Drawing Sheets

SYNCHRONOUS CONTROL METHOD AND APPARATUS FOR ROTARY STENCIL PRINTING PRESS

TECHNICAL FIELD

This invention relates to a synchronous control method and apparatus for a rotary stencil printing press equipped with a rotary screen printing unit, and a processing unit for performing processing other than stencil printing, such as an offset printing unit.

BACKGROUND ART

A rotary stencil printing press equipped with a rotary screen printing unit for doing screen printing (stencil printing), and a processing unit for performing processing other than stencil printing, such as an offset printing unit for doing offset printing, has so far been well known from Patent Document 1, etc.

SUMMARY OF INVENTION

Technical Problem

In the above-mentioned rotary stencil printing press, when the rotation of the rotary screen printing unit is started simultaneously with the rotation of the processing unit for performing processing other than stencil printing, a rotary screen cylinder rotates many times before paper to be actually printed comes to the rotary screen printing unit. This has posed the problem that ink within the rotary screen cylinder jumps out through holes of a screen printing forme, staining the surroundings. Alternatively, instead of jumping to the outside, the ink adheres to external parts of the holes. This has caused the problem that the ink adheres to the outside of pattern areas during printing, deteriorating printing quality.

The present invention has been accomplished to solve the foregoing problems by individually driving the rotary screen cylinder with the use of a dedicated motor; making it possible to set how many rotations have been made before arrival of paper at the rotary screen printing unit at the time of starting synchronous control for synchronization with the processing unit for performing processing other than stencil printing; and stopping the rotation of the rotary screen cylinder until then. It is an object of this invention to provide a synchronous control method and apparatus for a rotary stencil printing press which can prevent the staining of the surroundings with unnecessary ink or the deterioration of printing quality.

Solution to Problem

A first aspect of the present invention for attaining the above object is a synchronous control method for a rotary stencil printing press including a stencil printing plate cylinder for holding a stencil printing plate and transferring ink stored within the stencil printing plate cylinder through holes of the stencil printing plate to perform printing, and a processing unit for performing processing other than stencil printing, the synchronous control method comprising:

providing a first motor for rotationally driving the stencil printing plate cylinder, a second motor for rotationally driving the processing unit, and a rotation angle setting instrument for setting a rotation angle from a time when a material to be printed is supplied until synchronous control of the first motor with respect to the second motor is started; and starting the synchronous control of the first motor with respect to the second motor when the processing unit rotates through the rotation angle set by the rotation angle setting instrument after the material to be printed is supplied.

According to a second aspect of the present invention, the synchronous control method for a rotary stencil printing press may further comprise: providing a detector for detecting that the material to be printed has been supplied; and starting the synchronous control of the first motor with respect to the second motor when the processing unit rotates through the rotation angle set by the rotation angle setting instrument after the detector detects the material to be printed.

According to a third aspect of the present invention, the synchronous control method for a rotary stencil printing press may further comprise: providing a detector for detecting that the material to be printed has been supplied, and a one-revolution detector for detecting one revolution of the processing unit each time the processing unit makes the one revolution; counting a number of times the one-revolution detector has detected that the processing unit has made the one revolution after the detector detects the material to be printed; and starting the synchronous control of the first motor with respect to the second motor when the counted number equals a number set by the rotation angle setting instrument.

A fourth aspect of the present invention for attaining the aforementioned object is a synchronous control apparatus for a rotary stencil printing press including a stencil printing plate cylinder for holding a stencil printing plate and transferring ink stored within the stencil printing plate cylinder through holes of the stencil printing plate to perform printing, and a processing unit for performing processing other than stencil printing, the synchronous control apparatus comprising:

a first motor for rotationally driving the stencil printing plate cylinder;

a second motor for rotationally driving the processing unit;

a rotation angle setting instrument for setting a rotation angle from a time when a material to be printed is supplied until synchronous control of the first motor with respect to the second motor is started; and a control device for starting the synchronous control of the first motor with respect to the second motor when the processing unit rotates through the rotation angle set by the rotation angle setting instrument after the material to be printed is supplied.

According to a fifth aspect of the present invention, the synchronous control apparatus for a rotary stencil printing press may further comprise a detector for detecting that the material to be printed has been supplied, and the control device may start the synchronous control of the first motor with respect to the second motor when the processing unit rotates through the rotation angle set by the rotation angle setting instrument after the detector detects the material to be printed.

According to a sixth aspect of the present invention, the synchronous control apparatus for a rotary stencil printing press may further comprise a detector for detecting that the material to be printed has been supplied, and a one-revolution detector for detecting one revolution of the processing unit each time the processing unit makes the one revolution, and the control device may count a number of times the one-revolution detector has detected that the processing unit has made the one revolution after the detector detects the material to be printed, and may start the synchronous control of the first motor with respect to the second motor when the counted number equals a number set by the rotation angle setting instrument.

According to a seventh aspect of the present invention, the stencil printing plate may be a screen printing forme.

Advantageous Effects of Invention

According to the synchronous control method and apparatus for a rotary stencil printing press concerned with the present invention, synchronous control of the first motor, which rotationally drives the stencil printing plate cylinder, with respect to the second motor for rotationally driving the processing unit for performing processing other than stencil printing is started in timing for the supply of the material to be printed to the rotary screen printing unit. Thus, the staining of the surroundings with unnecessary ink or the deterioration of printing quality can be prevented.

DESCRIPTION OF EMBODIMENTS

The synchronous control method and apparatus for a rotary stencil printing press according to the present invention will be described in detail by an embodiment of the invention with reference to the accompanying drawings.

Embodiment

Figure 1A:
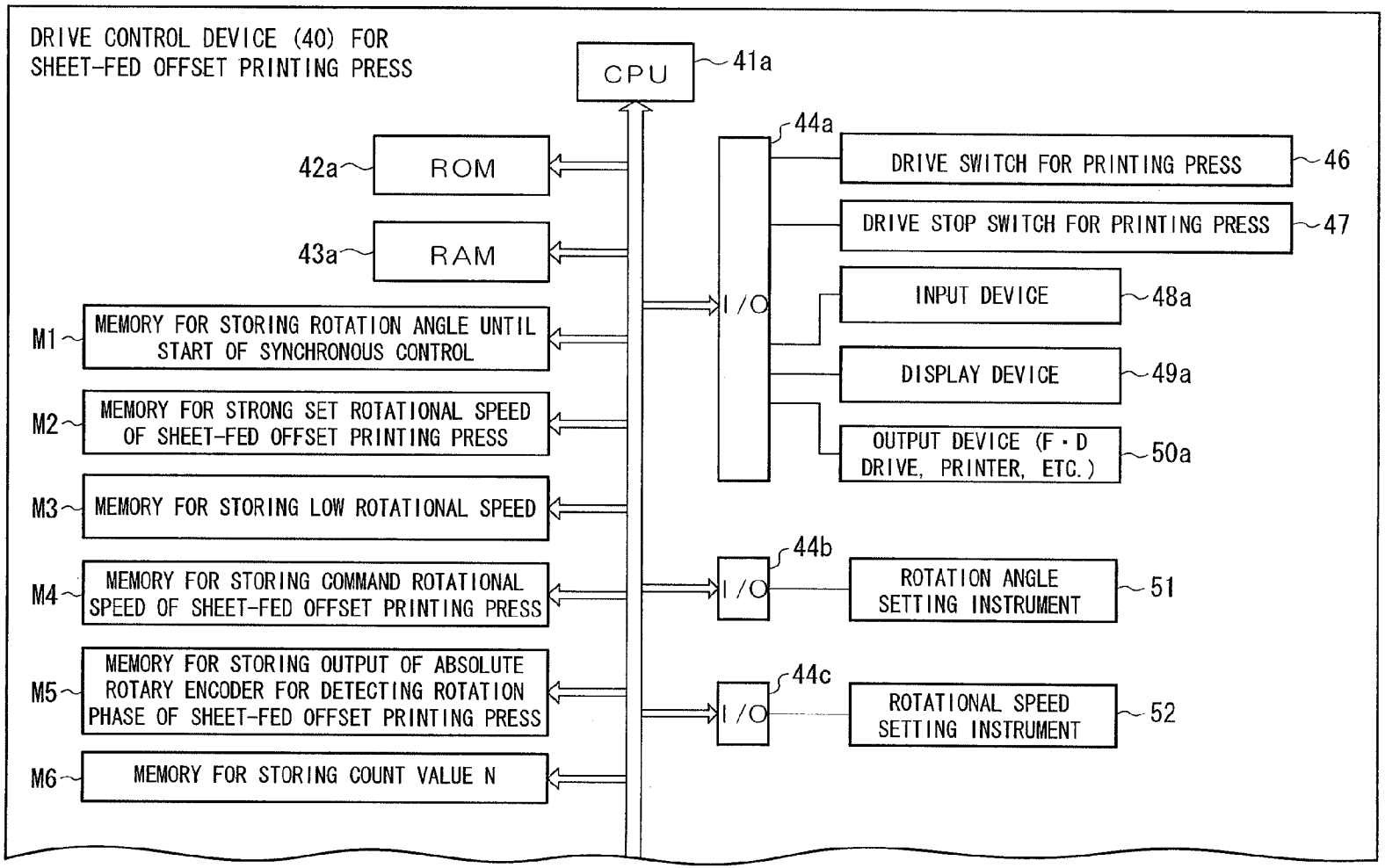
FIG. 1A is a block diagram of a drive control device for a sheet-fed offset printing press showing an embodiment of the present invention.
Figure 1B:
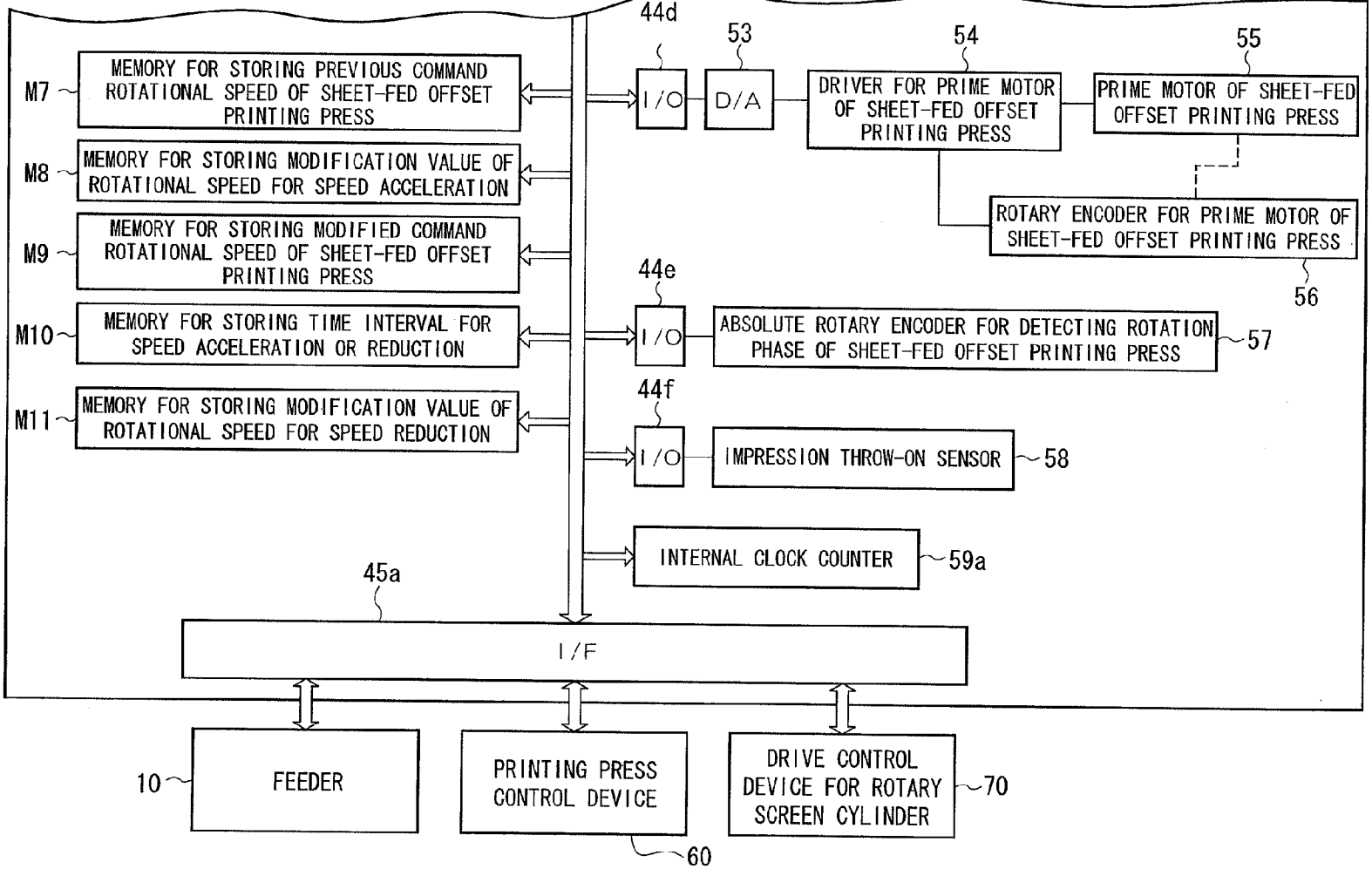
FIG. 1B is a block diagram of the drive control device for the sheet-fed offset printing press.
Figure 2A:
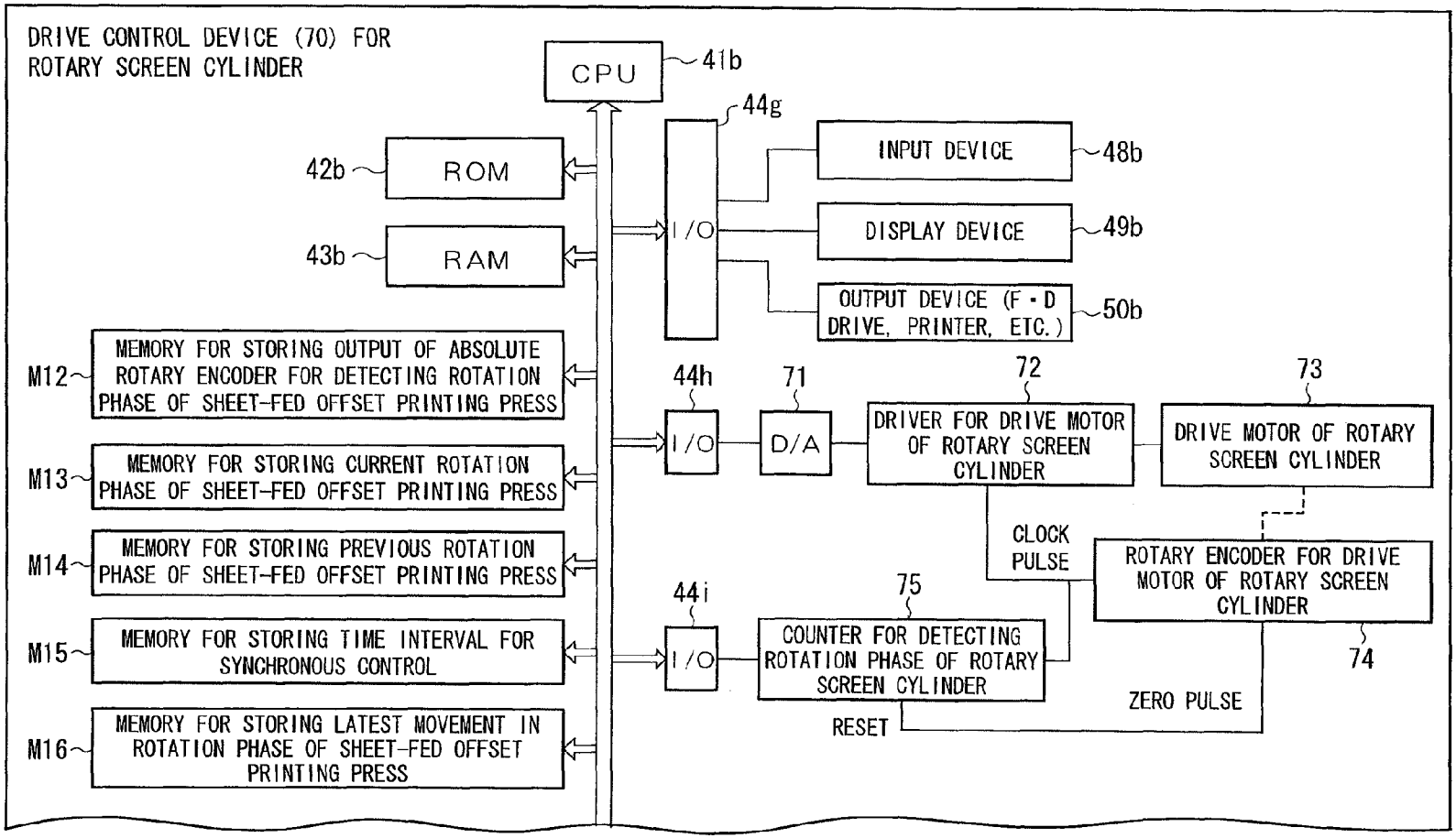
FIG. 2A is a block diagram of a drive control device for a rotary screen cylinder.
Figure 2B:
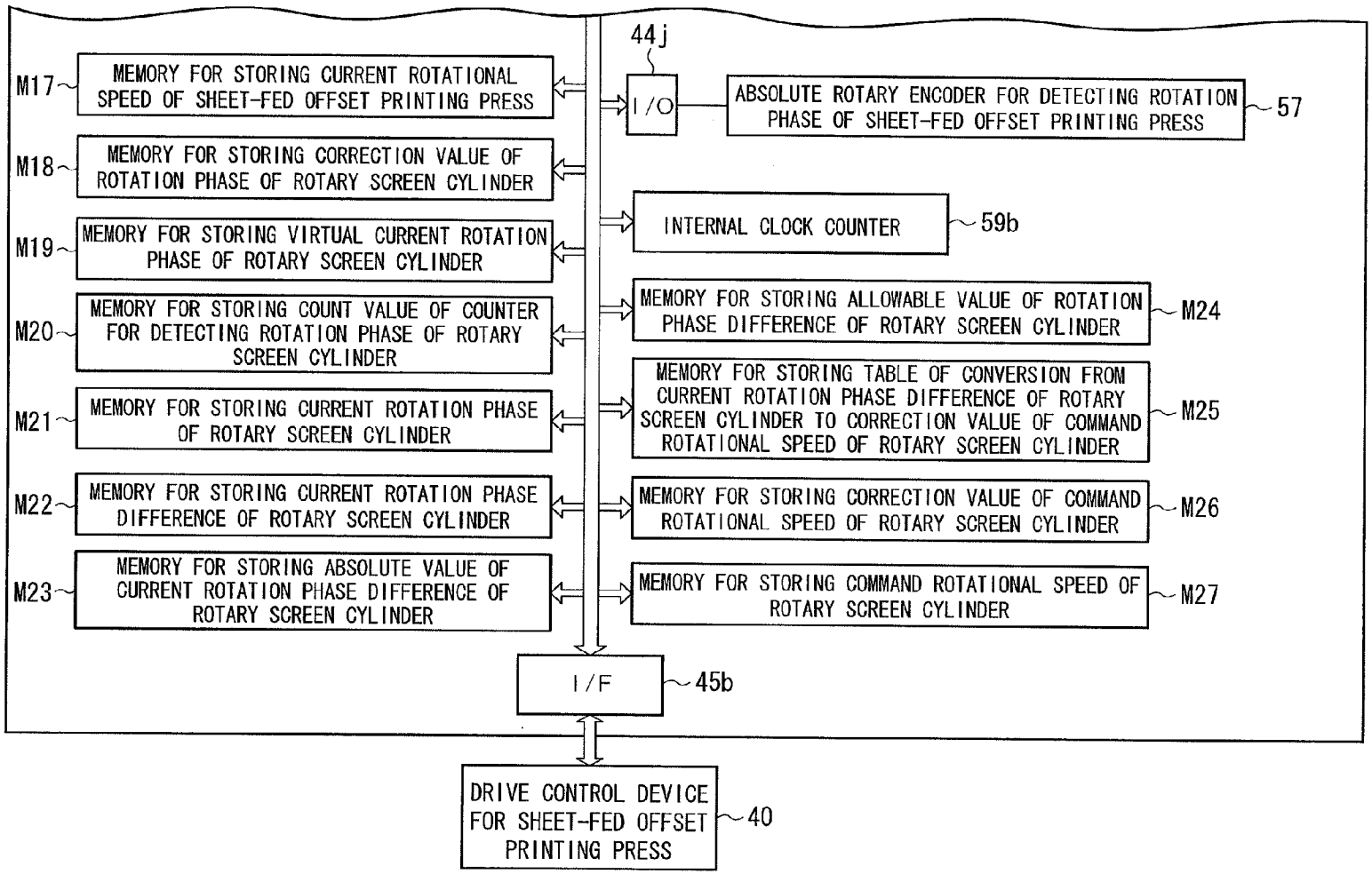
FIG. 2B is a block diagram of the drive control device for the rotary screen cylinder.
Figure 3A:
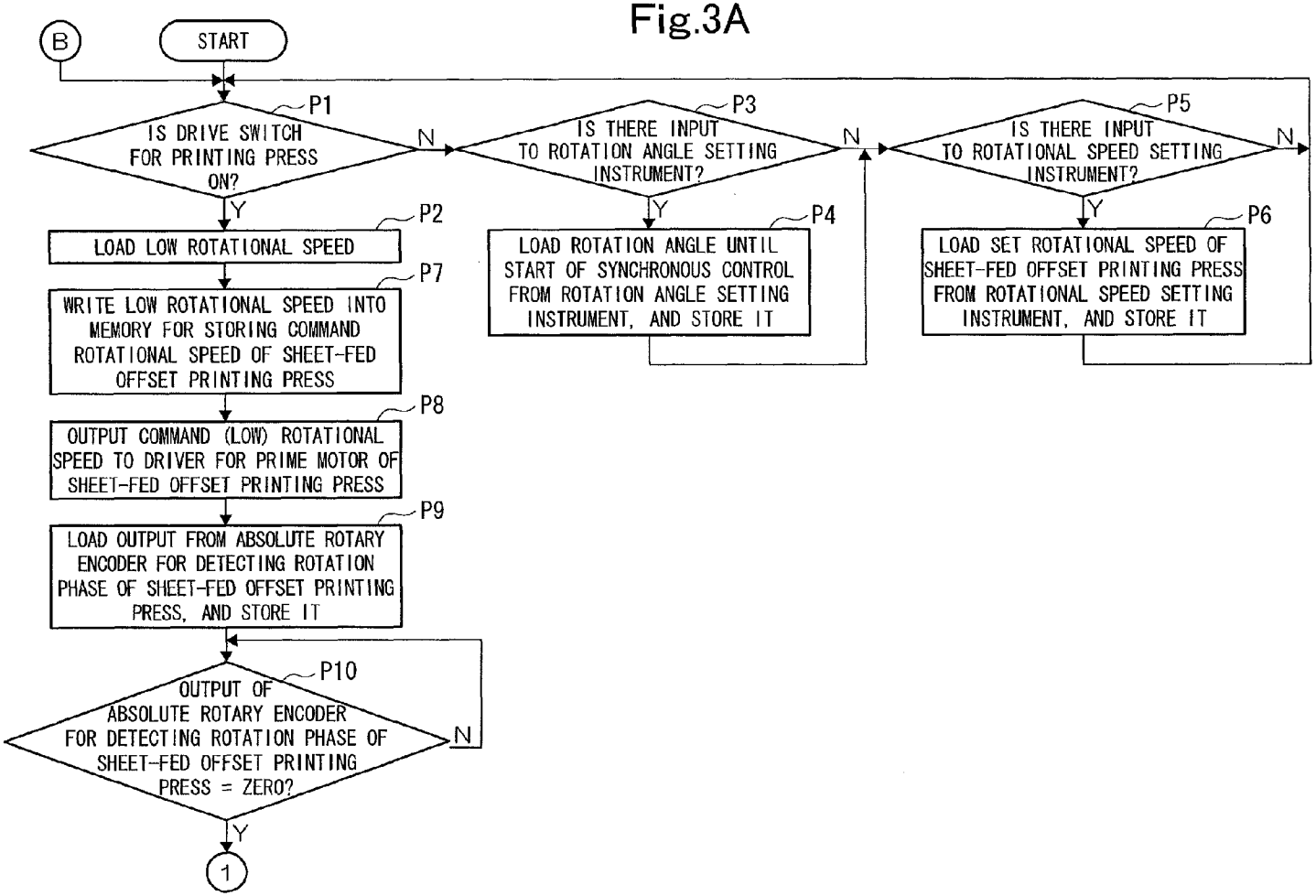
FIG. 3A is a motion flow chart of the drive control device for the sheet-fed offset printing press.
Figure 3B:
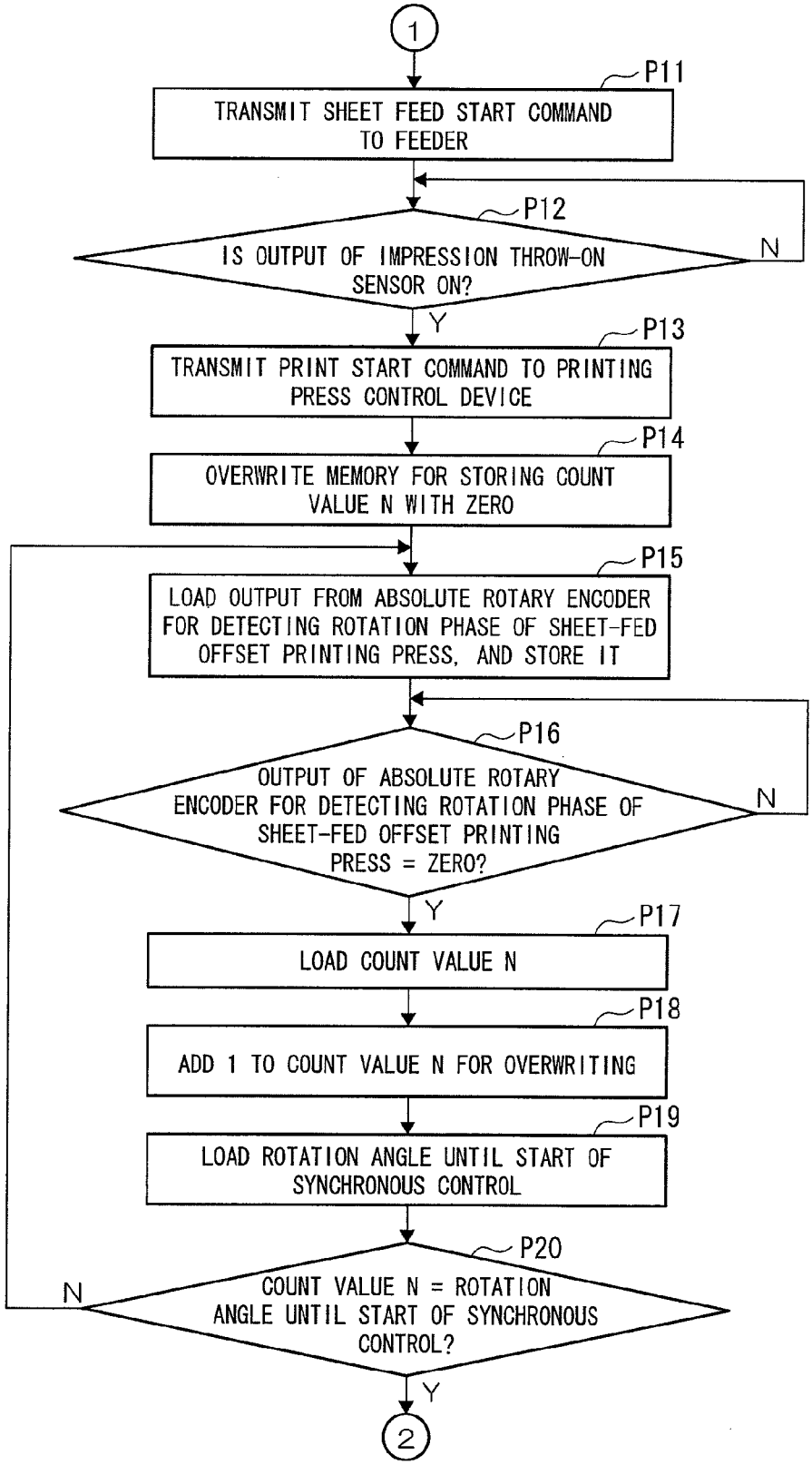
FIG. 3B is a motion flow chart of the drive control device for the sheet-fed offset printing press.
Figure 3C:
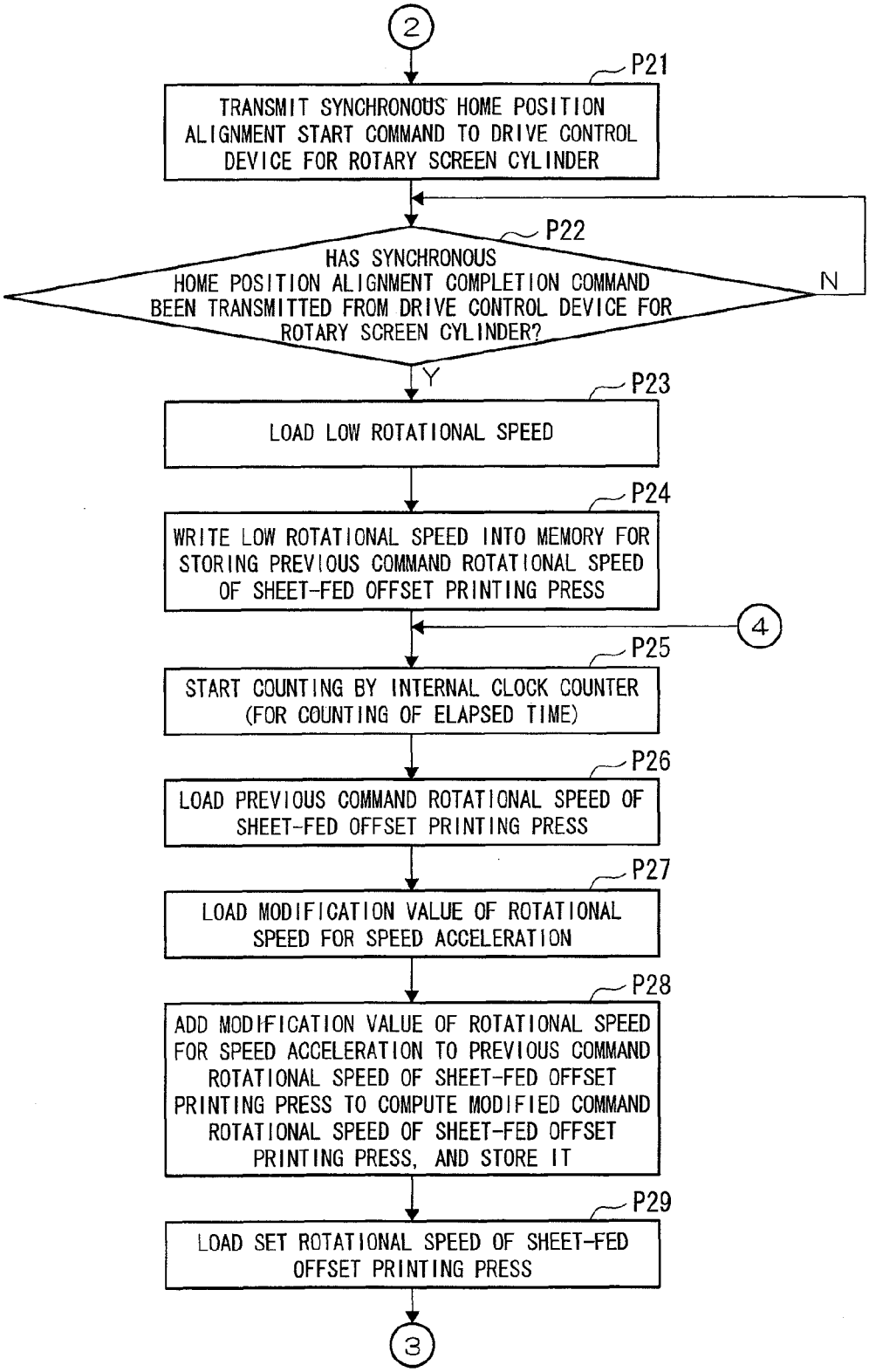
FIG. 3C is a motion flow chart of the drive control device for the sheet-fed offset printing press.
Figure 3D:
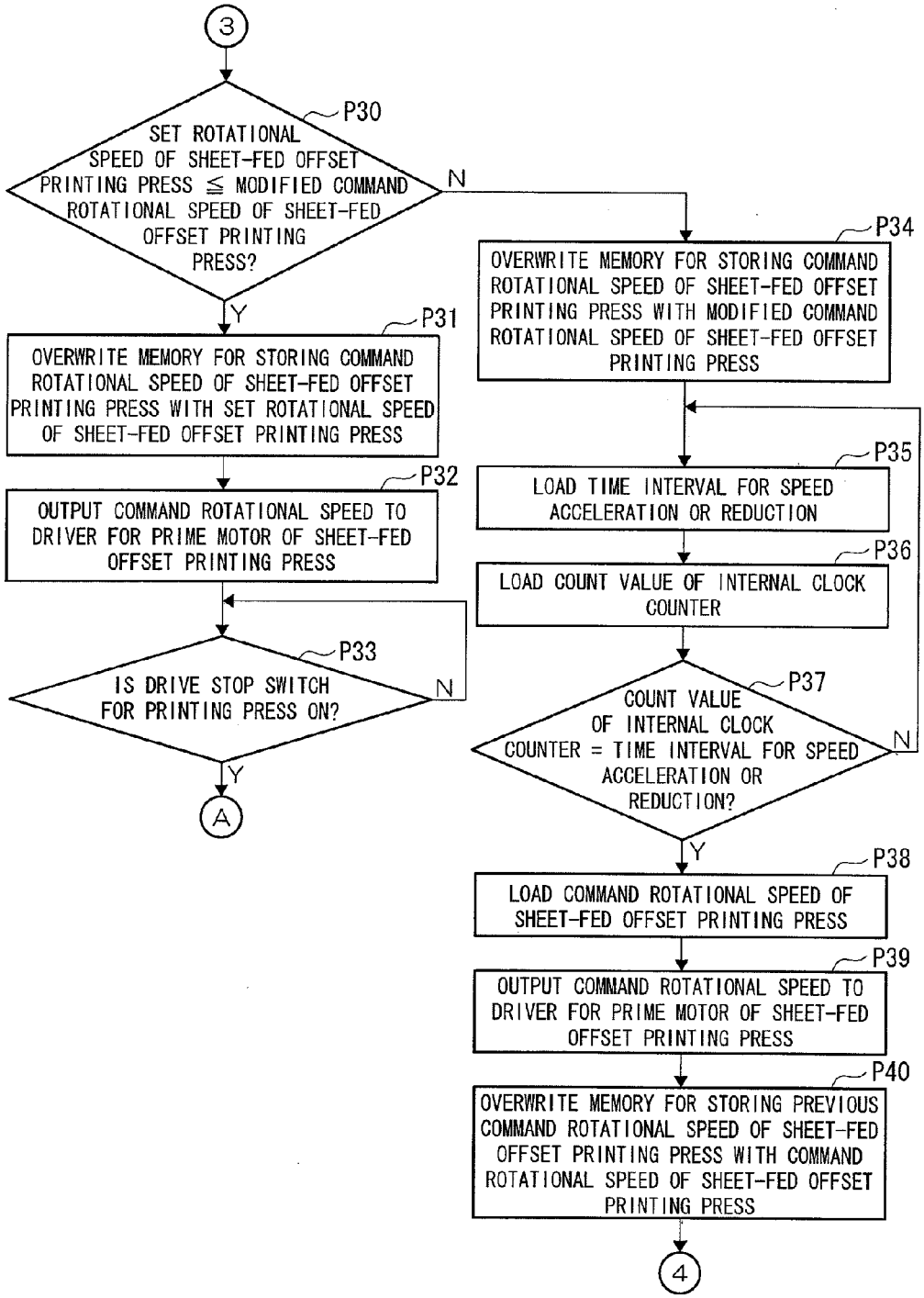
FIG. 3D is a motion flow chart of the drive control device for the sheet-fed offset printing press.
Figure 4A:
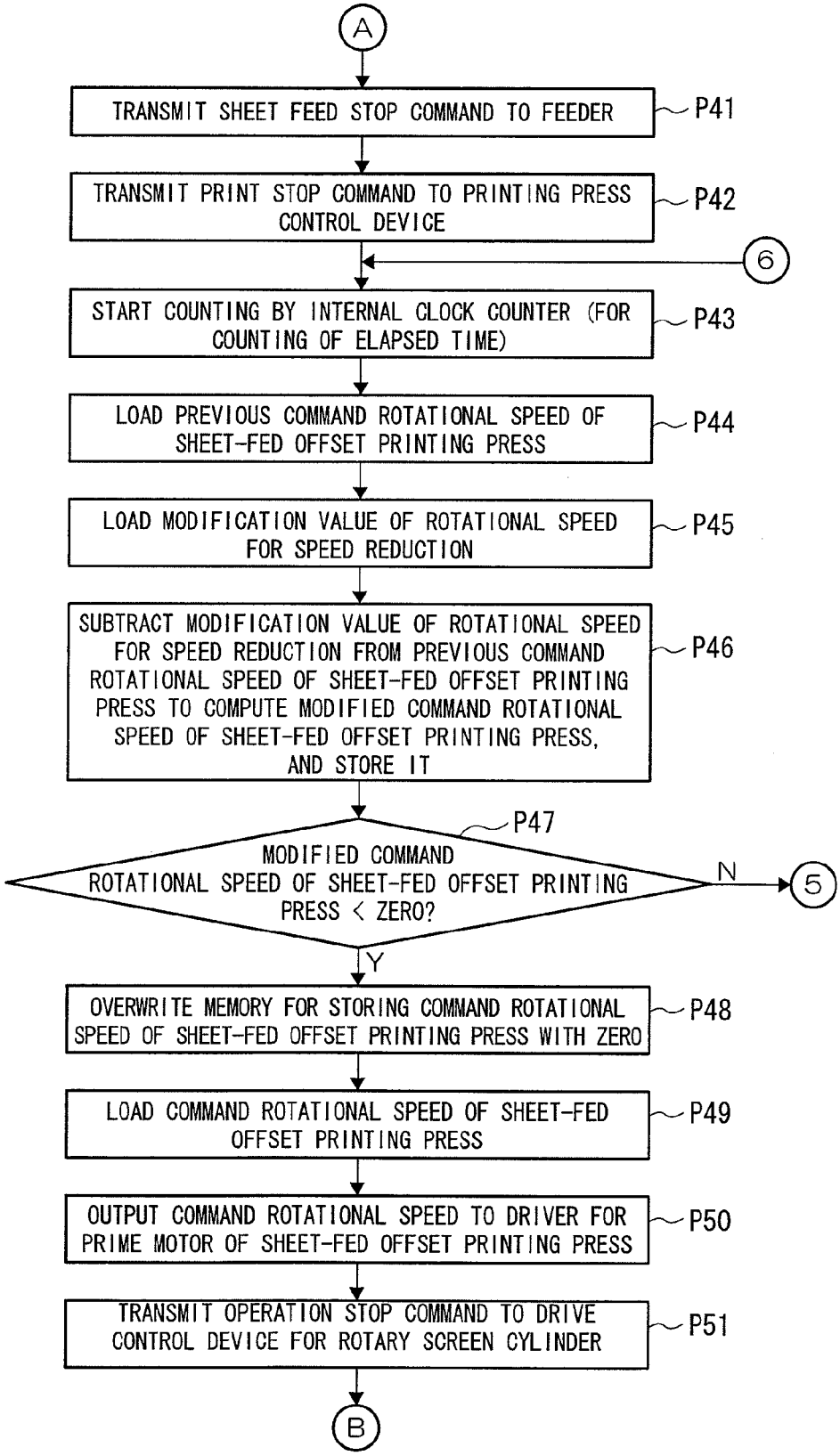
FIG. 4A is a motion flow chart of the drive control device for the sheet-fed offset printing press.
Figure 4B:
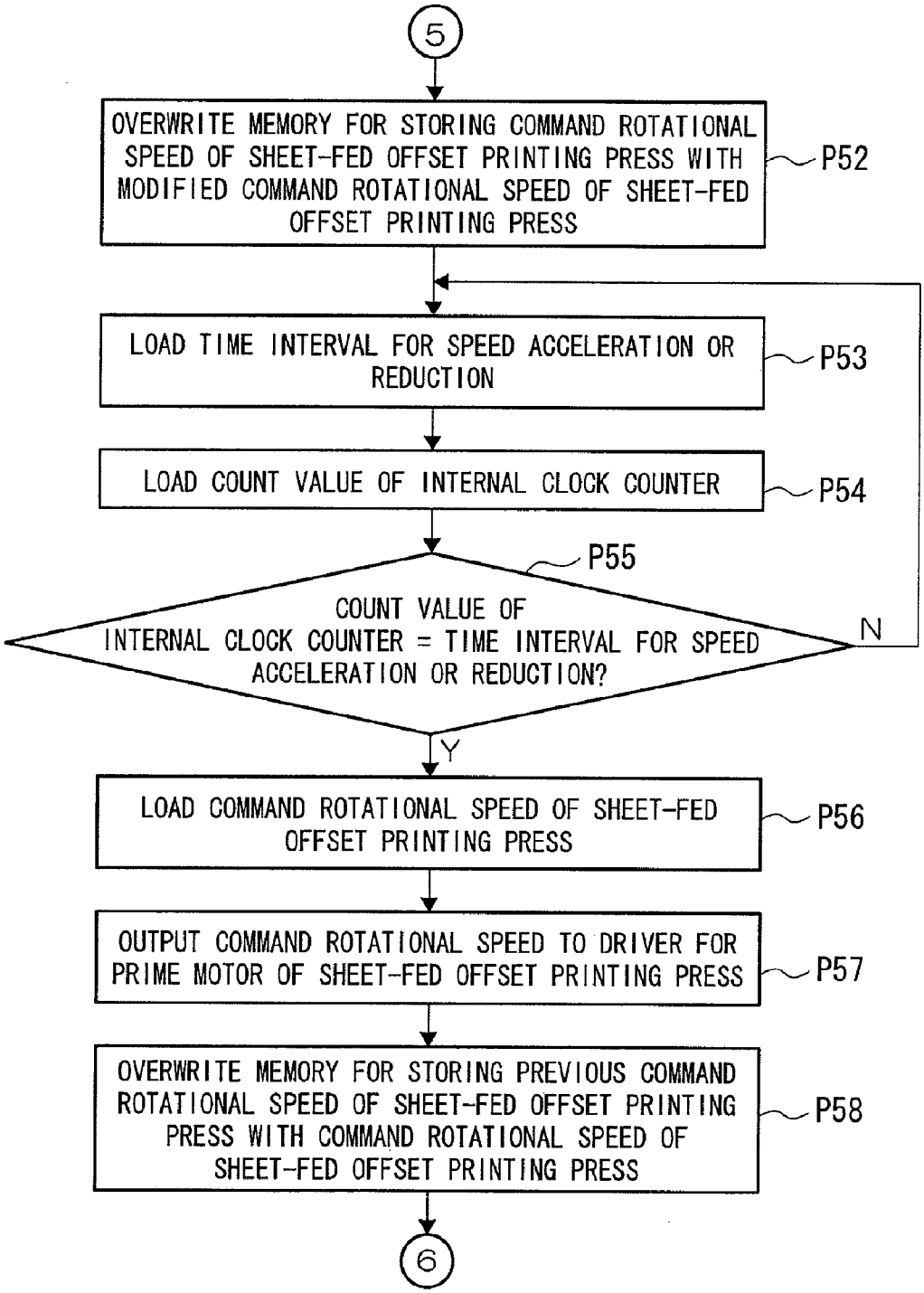
FIG. 4B is a motion flow chart of the drive control device for the sheet-fed offset printing press.
Figure 5A:
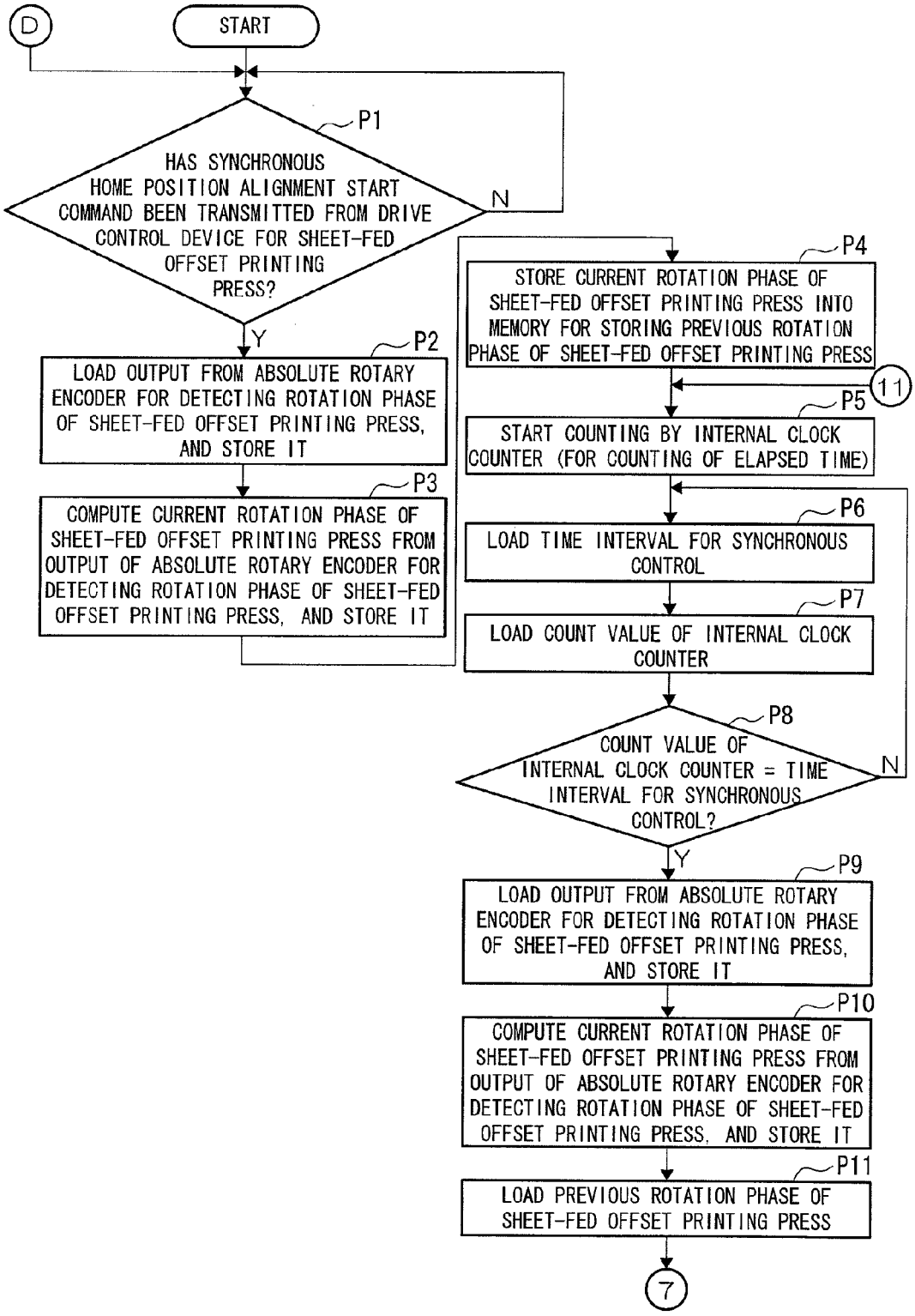
FIG. 5A is a motion flow chart of the drive control device for the rotary screen cylinder.
Figure 5B:
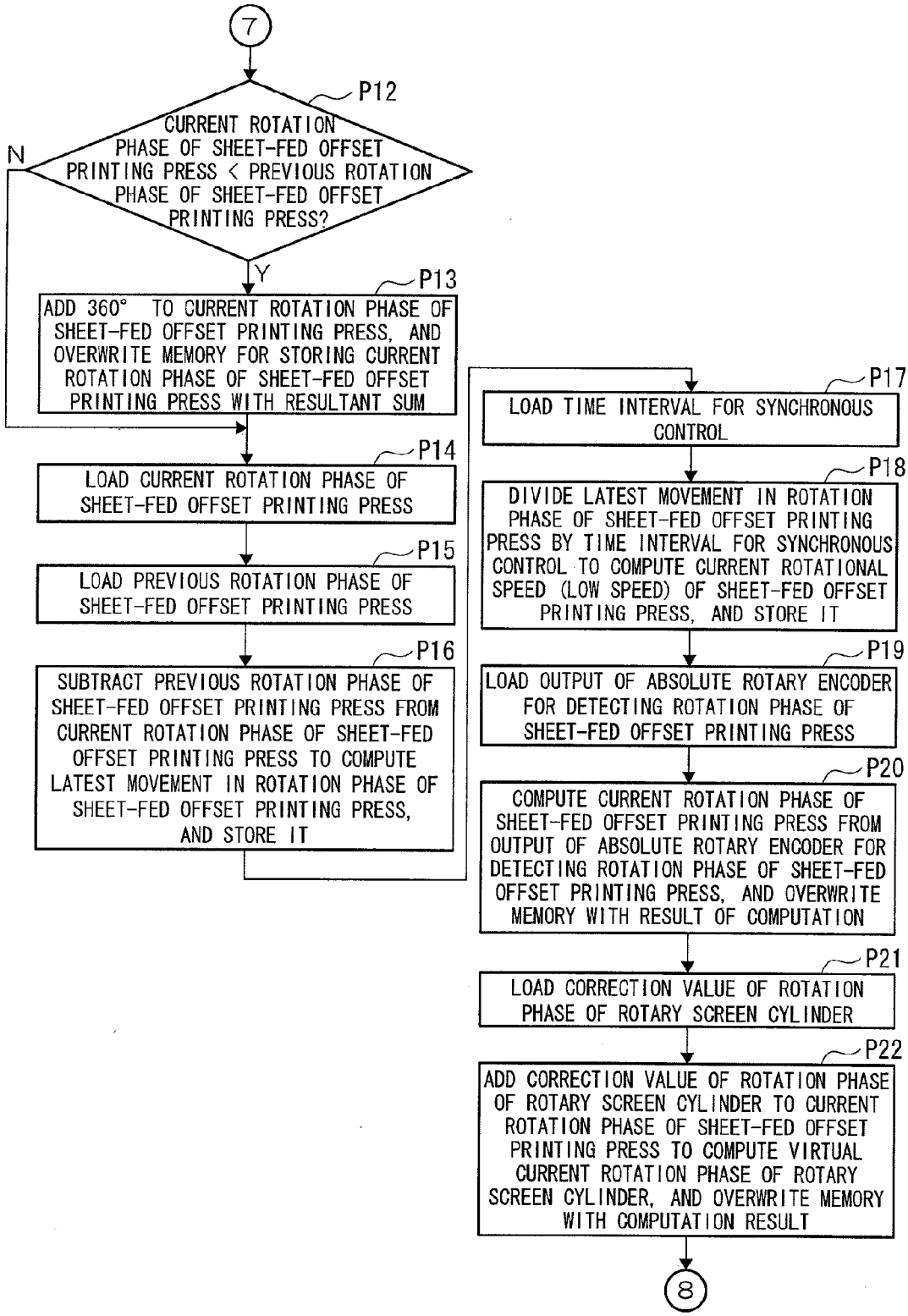
FIG. 5B is a motion flow chart of the drive control device for the rotary screen cylinder.
Figure 5C:
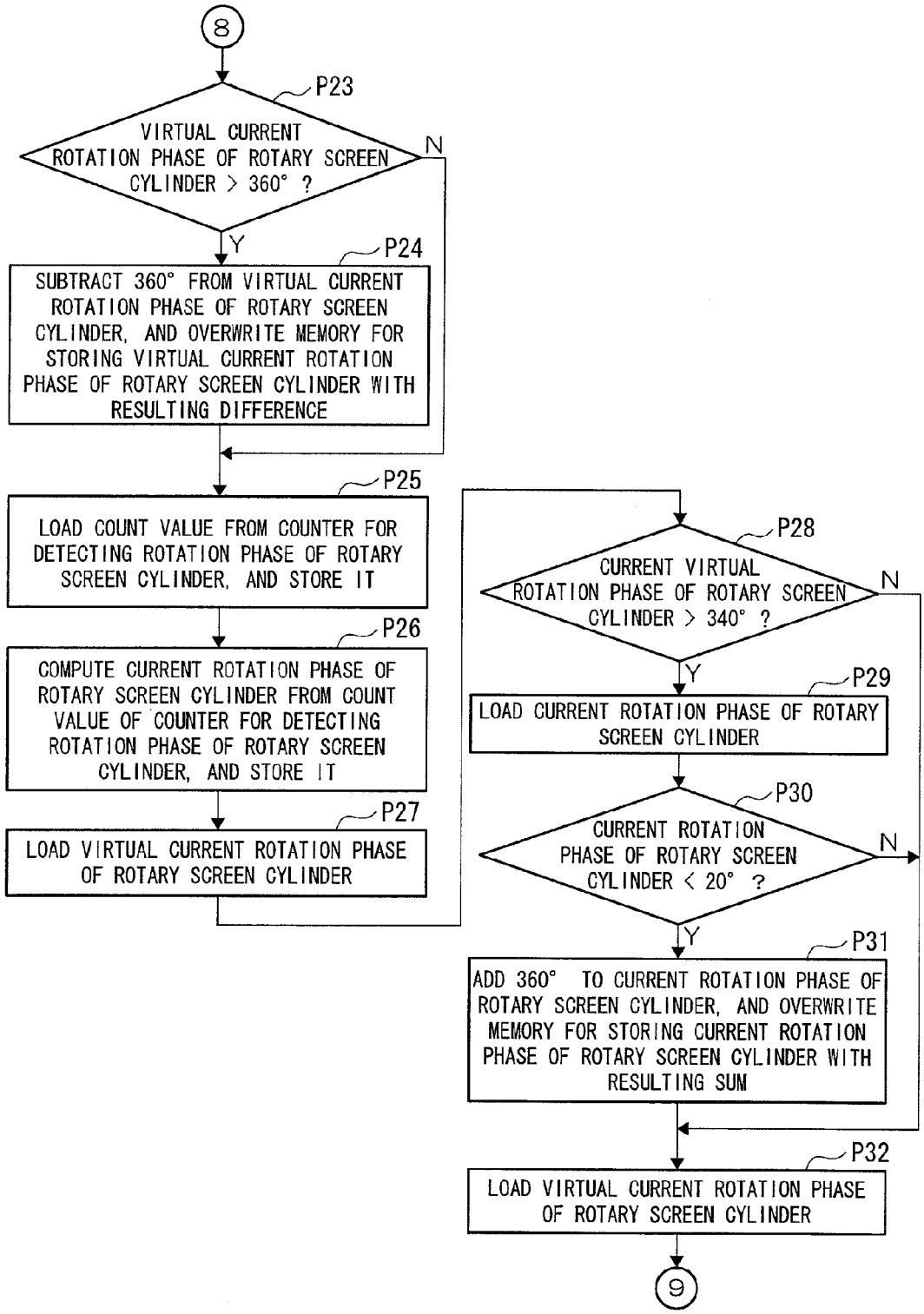
FIG. 5C is a motion flow chart of the drive control device for the rotary screen cylinder.
Figure 5D:
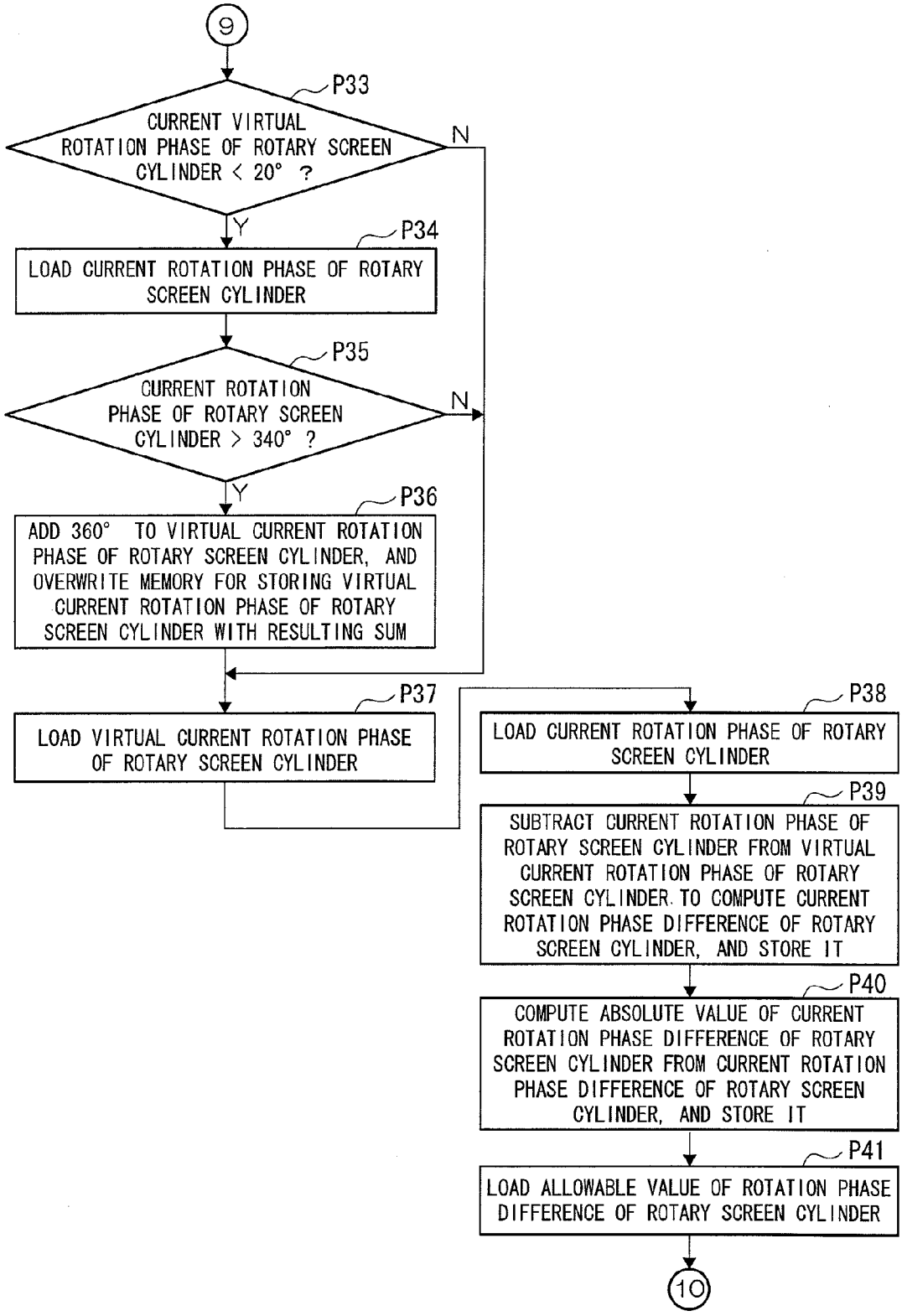
FIG. 5D is a motion flow chart of the drive control device for the rotary screen cylinder.
Figure 5E:
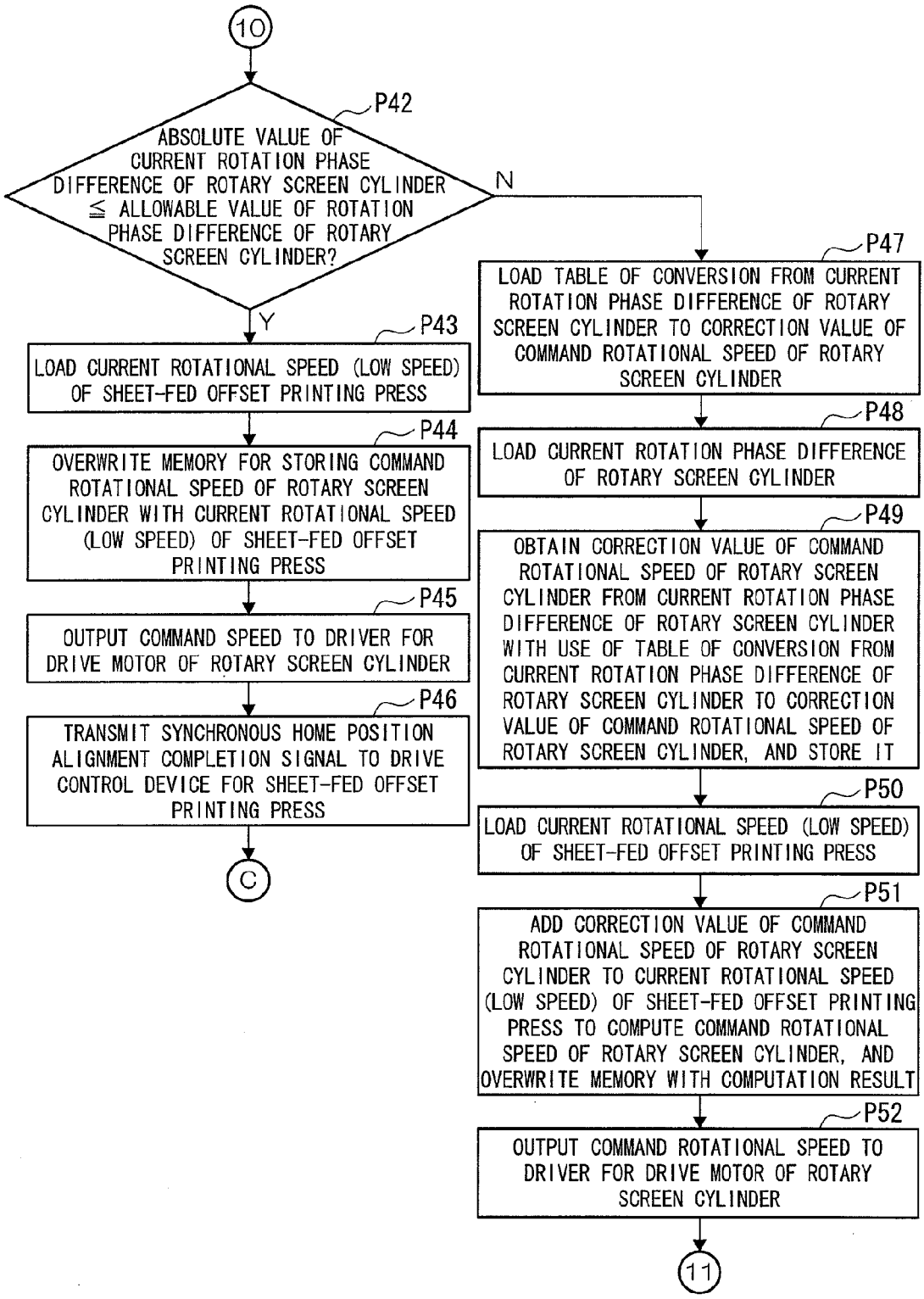
FIG. 5E is a motion flow chart of the drive control device for the rotary screen cylinder.
Figure 6A:
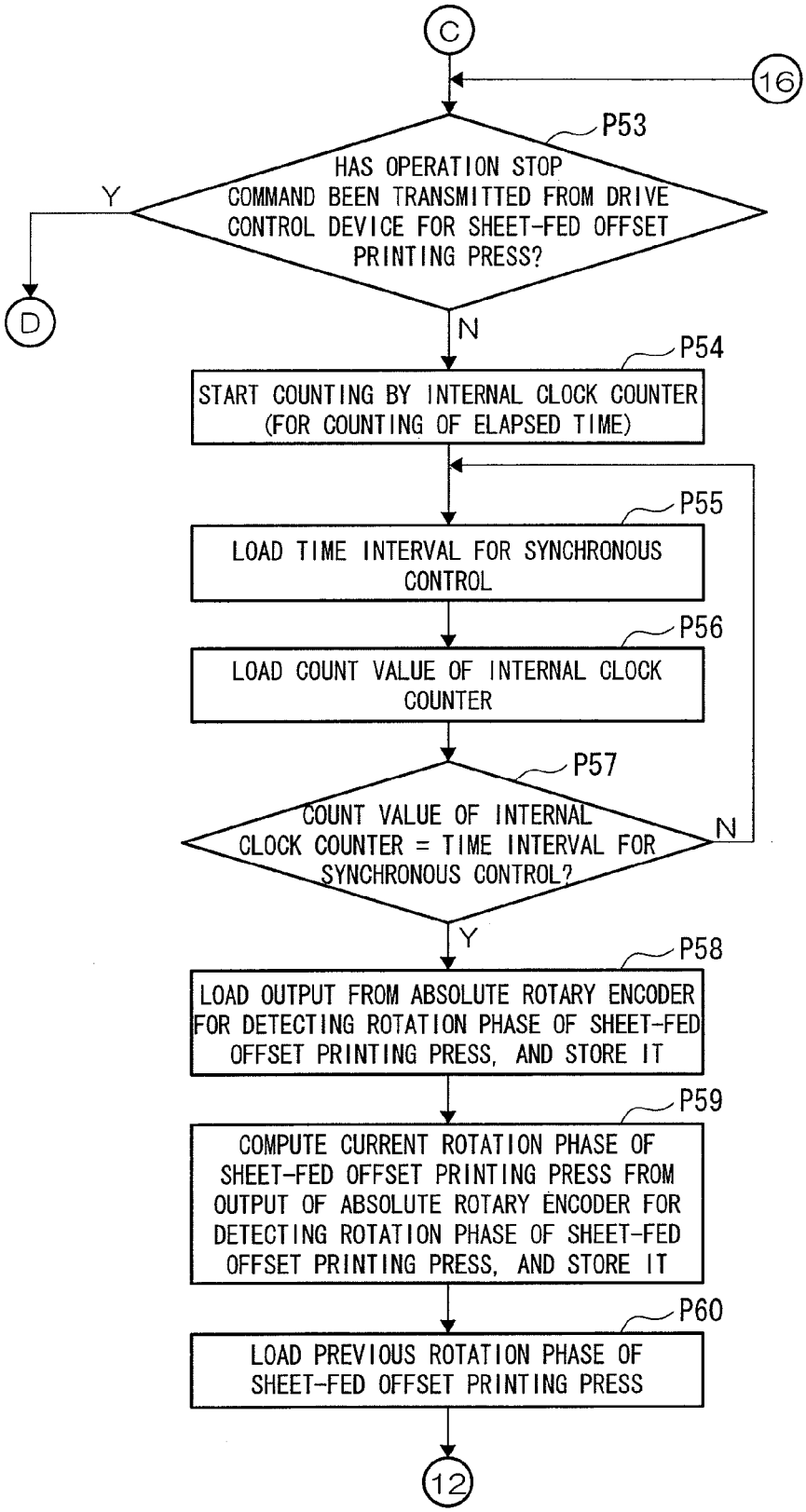
FIG. 6A is a motion flow chart of the drive control device for the rotary screen cylinder.
Figure 6B:
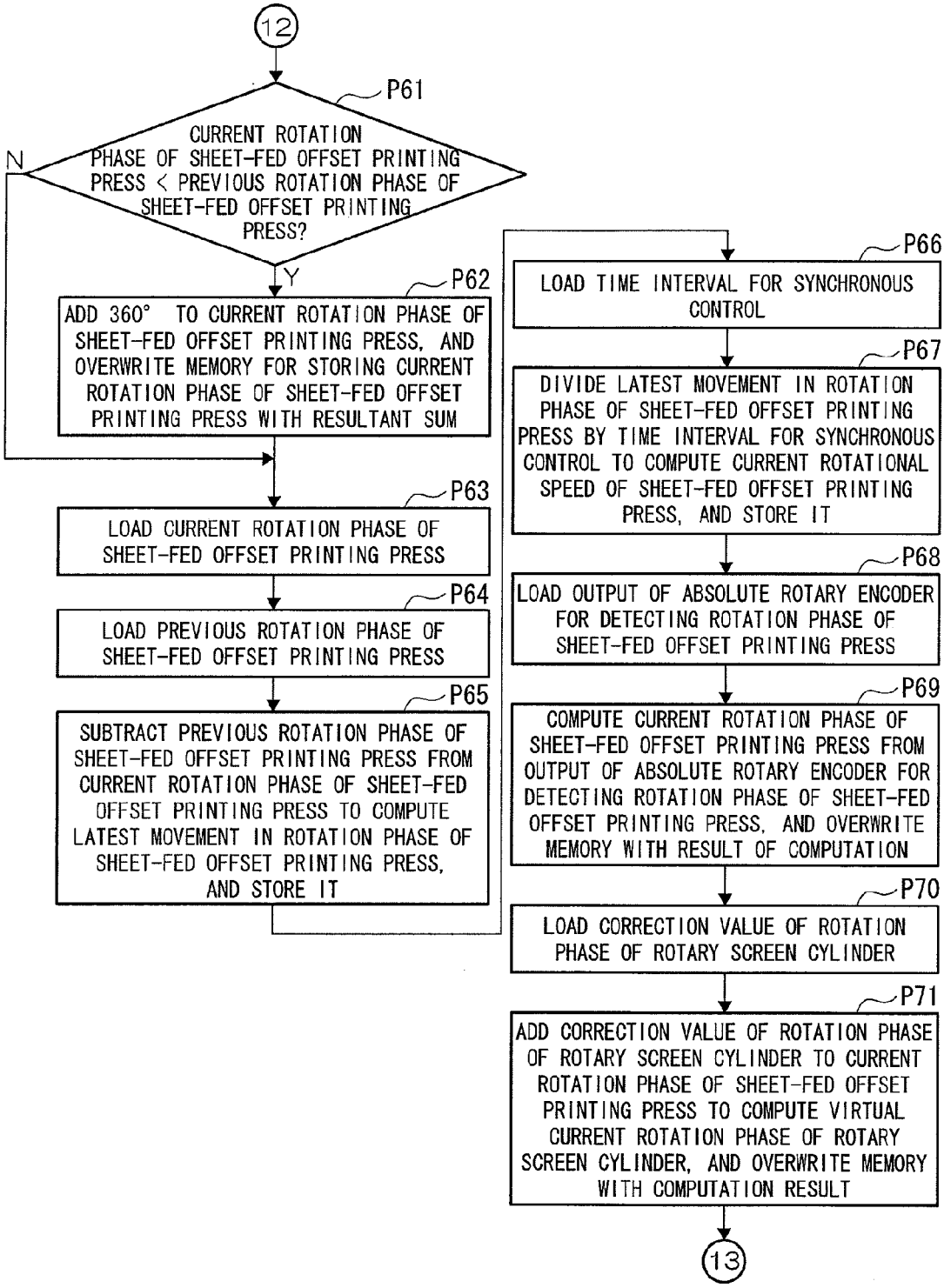
FIG. 6B is a motion flow chart of the drive control device for the rotary screen cylinder.
Figure 6C:
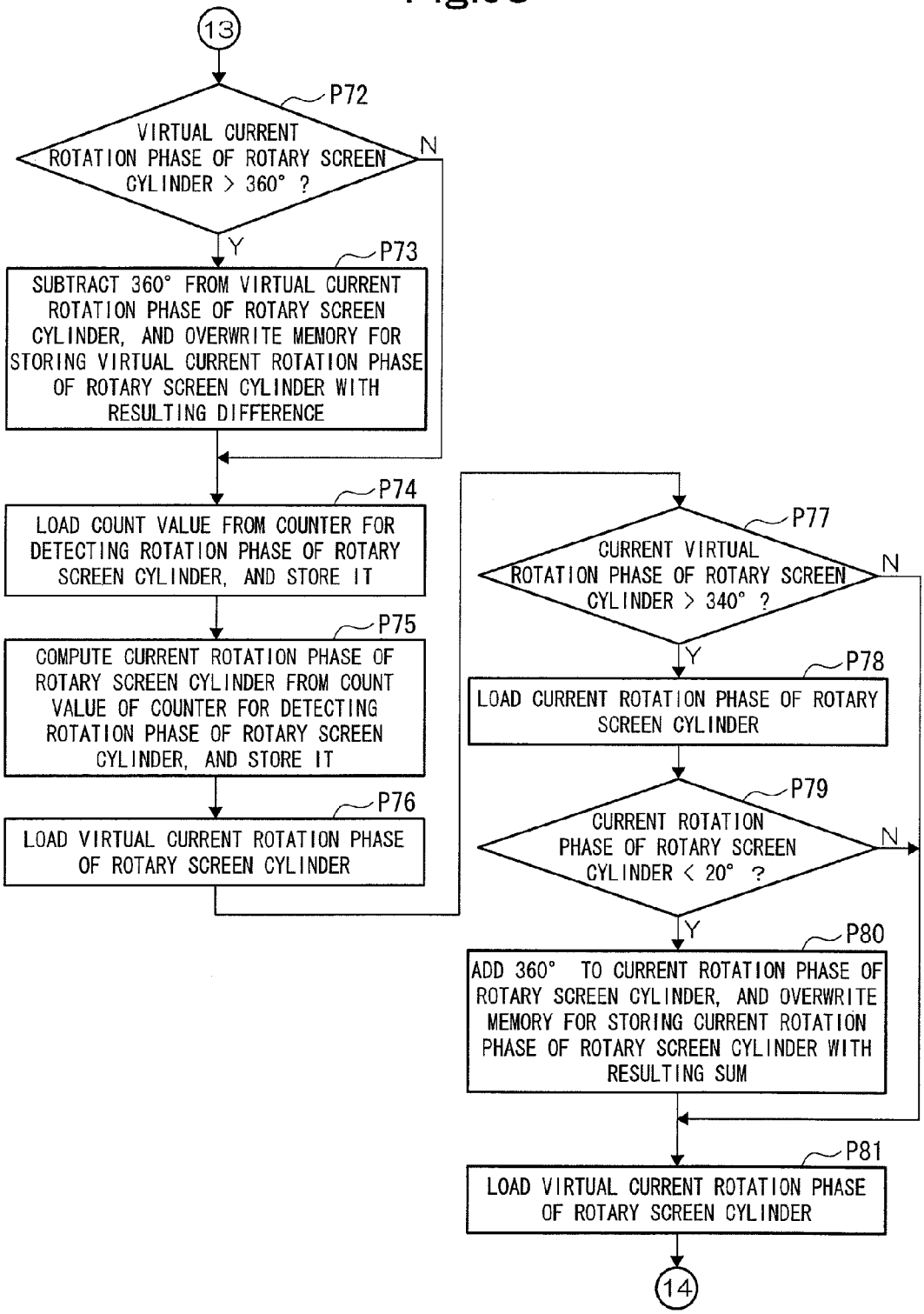
FIG. 6C is a motion flow chart of the drive control device for the rotary screen cylinder.
Figure 6D:
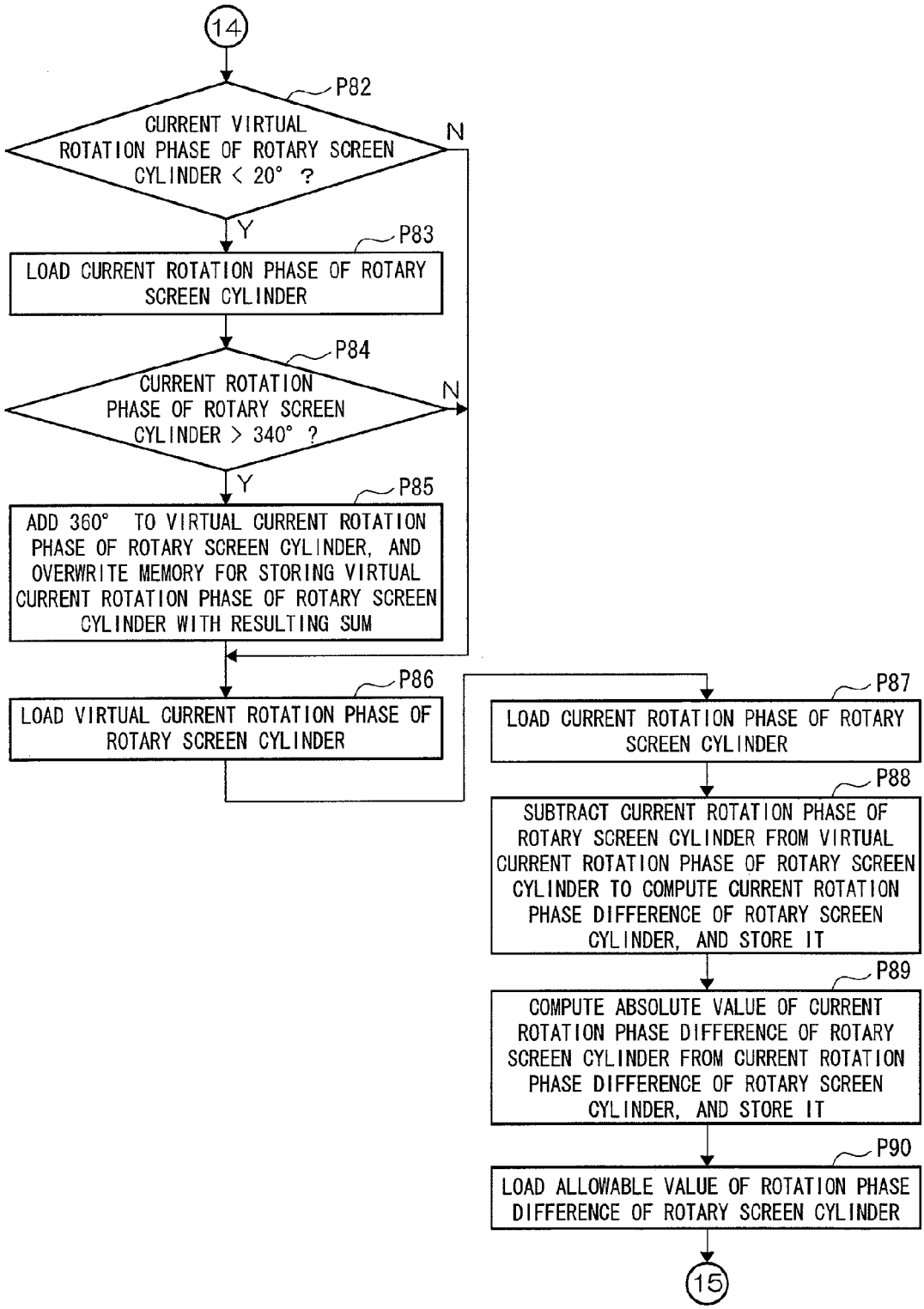
FIG. 6D is a motion flow chart of the drive control device for the rotary screen cylinder.
Figure 6E:
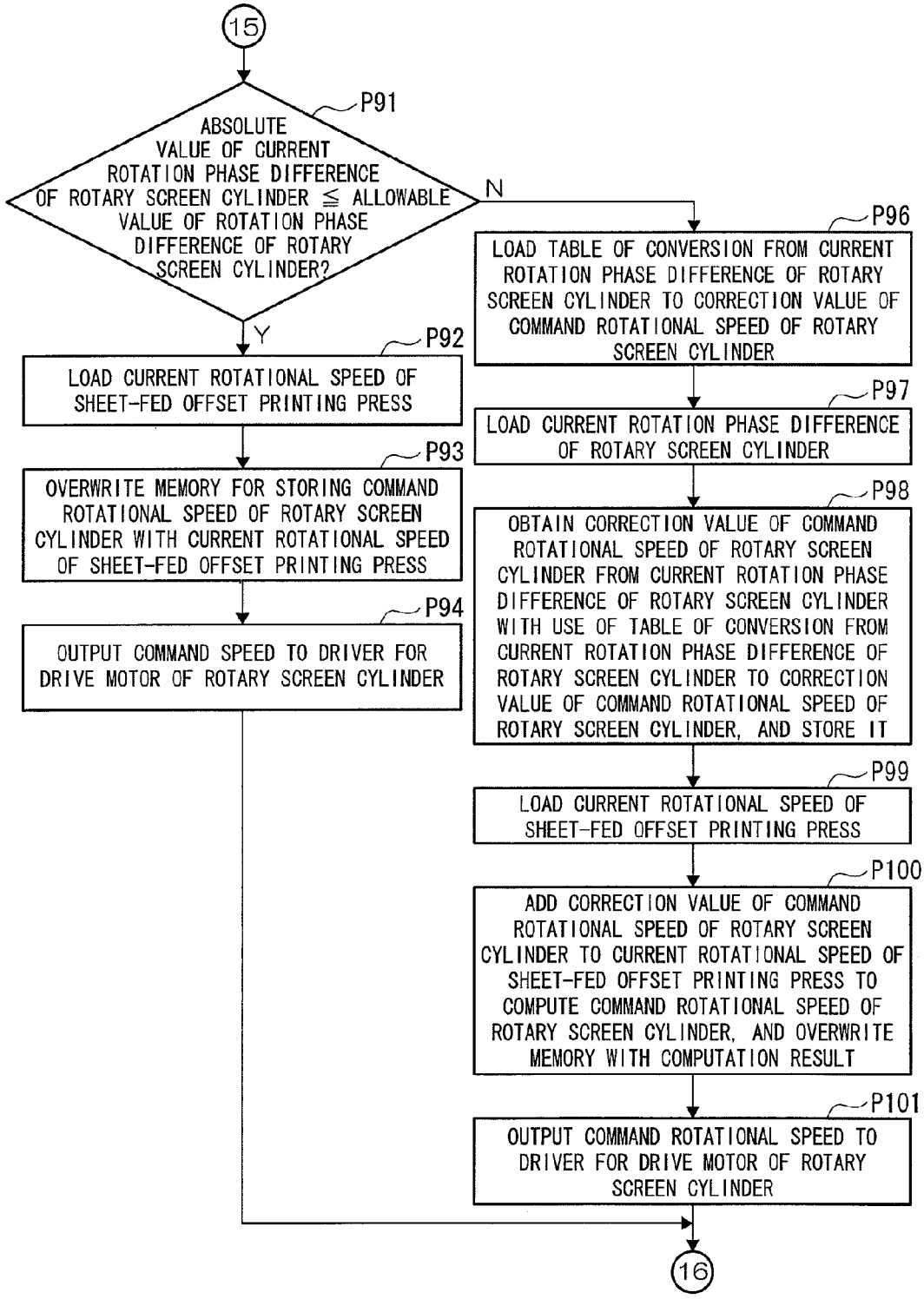
FIG. 6E is a motion flow chart of the drive control device for the rotary screen cylinder.
Figure 7:
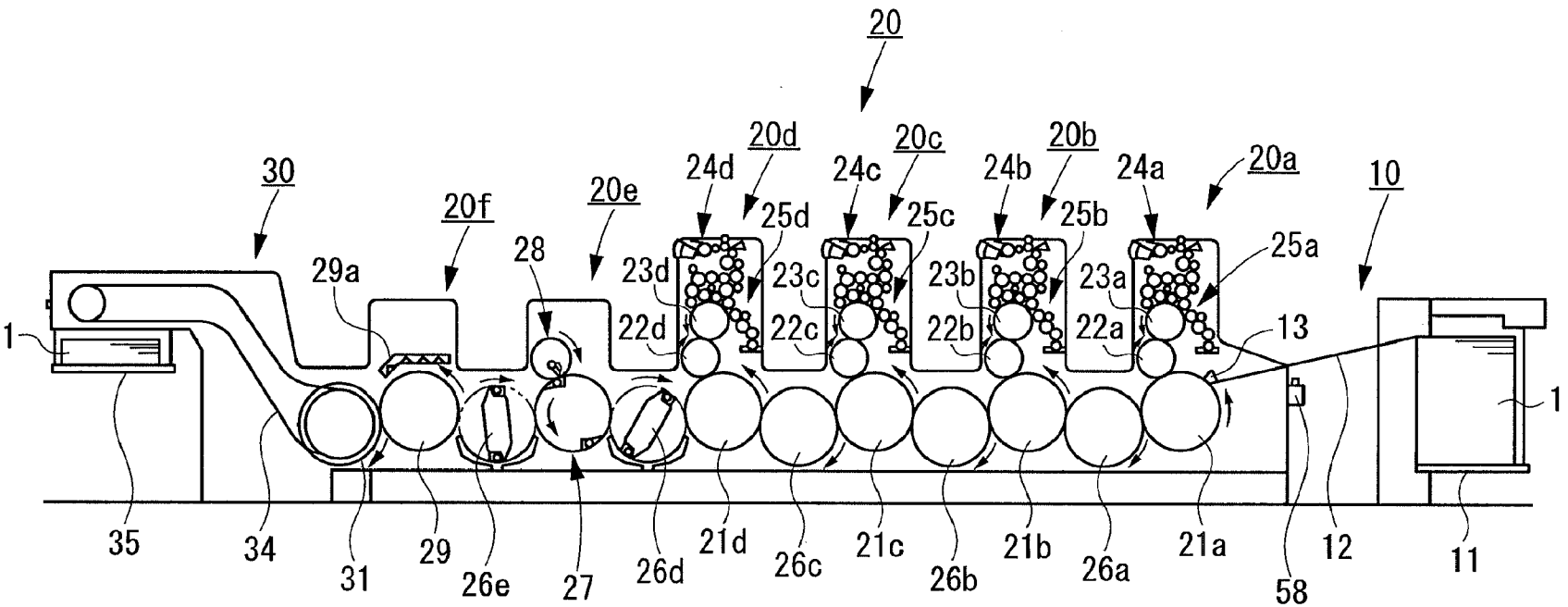
FIG. 7 is a general schematic configurational drawing of the sheet-fed offset printing press.

FIGS. 1A and 1B are block diagrams of a drive control device for a sheet-fed offset printing press showing an embodiment of the present invention. FIGS. 2A and 2B are block diagrams of a drive control device for a rotary screen cylinder. FIGS. 3A to 3D are motion flow charts of the drive control device for the sheet-fed offset printing press. FIGS. 4A and 4B are motion flow charts of the drive control device for the sheet-fed offset printing press. FIGS. 5A to 5E are motion flow charts of the drive control device for the rotary screen cylinder. FIGS. 6A to 6E are motion flow charts of the drive control device for the rotary screen cylinder. FIG. 7 is a general schematic configurational drawing of the sheet-fed offset printing press.

As shown in FIG. 7, a feeder tray 11 is provided in a feeder 10 of a sheet-fed offset printing press (a rotary stencil printing press equipped with a processing unit for performing processing other than stencil printing). The feeder 10 is provided with a feeder board 12 for feeding sheets (materials to be printed) 1 placed on the feeder tray 11, one by one, to a printing unit 20. A swing arm shaft pregripper 13 for passing the sheet 1 on to an impression cylinder 21*a* of a first offset printing unit 20*a* of the printing unit 20 is provided at the leading end of the feeder board 12.

A blanket cylinder 22*a* is in contact with a side of the impression cylinder 21*a*, downstream of the swing arm shaft pregripper 13 in the rotating direction of the impression cylinder 21*a*, of the first offset printing unit 20*a* of the printing unit 20. A plate cylinder 23*a* is in contact with a side of the blanket cylinder 22*a* upstream of the impression cylinder 21*a* in the rotating direction of the blanket cylinder 22*a*. An ink supply device 24*a* is provided upstream, in the rotating direction of the plate cylinder 23*a*, of the blanket cylinder 22*a*. A dampening unit 25*a* is provided upstream, in the rotating direction of the plate cylinder 23*a*, of the ink supply device 24*a*.

A side of the impression cylinder 21*a* downstream, in the rotating direction of the impression cylinder 21*a*, of the blanket cylinder 22*a* in the first offset printing unit 20*a* is in contact with an impression cylinder 21*b* of a second offset printing-unit 20*b* via a transfer cylinder 26*a*. The second offset printing unit 20*b* is equipped with a blanket cylinder 22*b*, a plate cylinder 23*b*, an ink supply device 24*b*, and a dampening unit 25*b*, as is the first offset printing unit 20*a*.

A side of the impression cylinder 21*b* downstream, in the rotating direction of the impression cylinder 21*b*, of the blanket cylinder 22*b* in the second offset printing unit 20*b* is in contact with an impression cylinder 21*c* of a third offset printing unit 20*c* via a transfer cylinder 26*b*. The third offset printing unit 20*c* is also equipped with a blanket cylinder 22*c*, a plate cylinder 23*c*, an ink supply device 24*c*, and a dampening unit 25*c*, as are the first and second offset printing units 20*a* and 20*b*.

A side of the impression cylinder 21*c* downstream, in the rotating direction of the impression cylinder 21*c*, of the blanket cylinder 22*c* in the third offset printing unit 20*c* is in contact with an impression cylinder 21*d* of a fourth offset printing unit 20*d* via a transfer cylinder 26*c*. The fourth offset printing unit 20*d* is also equipped with a blanket cylinder 22*d*, a plate cylinder 23*d*, an ink supply device 24*d*, and a dampening unit 25*d*, as are the first to third offset printing units 20*a* to 20*c*.

An impression cylinder 27 of a screen printing unit (a rotary stencil printing press equipped with a stencil printing plate cylinder) 20*e* is in contact with a side of the impression cylinder 21*d* downstream, in the rotating direction of the impression cylinder 21*d*, of the blanket cylinder 22*d* in the fourth offset printing unit 20*d* via a transfer cylinder 26*d* provided with an air blowing guide device which is composed of a skeleton cylinder (solid cylinder).

A rotary screen cylinder (stencil printing plate cylinder) 28 is in contact with a side of the impression cylinder 27 downstream, in the rotating direction of the impression cylinder 27, of the transfer cylinder 26*d* in the screen printing unit 20*e*. The rotary screen cylinder 28 holds a screen printing forme (stencil printing plate), and transfers ink, stored inside the rotary screen cylinder 28, to the sheet 1 through openings or holes of the screen printing forme for printing purposes.

A transport cylinder 29 of a drying unit 20*f* is in contact with a side of the impression cylinder 27 downstream, in the rotating direction of the impression cylinder 27, of the rotary screen cylinder 28 in the screen printing unit 20*e* via a transfer cylinder 26*e* provided with an air blowing guide device which is composed of a skeleton cylinder (solid cylinder). The drying unit 20*f* dries special ink of a pattern, printed on the sheet 1, with UV from a drying lamp 29*a*.

A delivery cylinder 31 of a delivery unit 30 is in contact with a side of the transport cylinder 29 downstream, in the rotating direction of the transport cylinder 29, of the drying lamp 29*a* in the drying unit 20*f*. A delivery chain 34 is looped over the delivery cylinder 31, and the sheet 1 transported by the delivery chain 34 is delivered onto a delivery pile board 35. In FIG. 7, an impression throw-on sensor (detector) 58 detects that the first sheet 1 has been supplied to a corresponding position of the feeder board 12.

In the present sheet-fed offset printing press, therefore, the sheets 1 are fed, one by one, from the feeder tray 11 of the feeder 10 onto the feeder board 12. The sheet 1 is passed on to the impression cylinder 21*a* of the first offset printing unit 20*a* of the printing unit 20 by the swing arm shaft pregripper 13. Separately, ink and dampening water are supplied from the ink supply device 24*a* and the dampening unit 25*a* of the first offset printing unit 20*a* to the plate cylinder 23*a*, and then supplied from the plate cylinder 23*a* to the blanket cylinder 22*a*.

Thus, the sheet 1 has the ink transferred thereto from the blanket cylinder 22*a* to be printed in a first color. Then, the sheet 1 is passed on to the impression cylinder 21*b* of the second offset printing unit 20*b* via the transfer cylinder 26*a*, and is subjected to printing in a second color in the second offset printing unit 20*b*, as in the first offset printing unit 20*a*. Afterwards, the sheet 1 is similarly printed in a third color and a fourth color in the third and fourth offset printing units 20*c* and 20*d*.

Then, the sheet 1 is passed on to the impression cylinder 27 of the screen printing-unit 20*e* via the transfer cylinder 26*d*. In this screen printing unit 20*e*, special ink stored within the rotary screen cylinder 28 is passed through the holes of the screen printing forme and supplied to the sheet 1, whereby thick-film printing with the special ink corresponding to the holes of the screen printing forme is carried out.

Then, the sheet 1 is passed from the impression cylinder 27 on to the transport cylinder 29 of the drying unit 20*f* via the transfer cylinder 26*e*, and the printed special ink is dried with UV from the drying lamp 29*a*. Then, the sheet 1 is passed on to the delivery cylinder 31 of the delivery unit 30, from where the sheet 1 is transported by the delivery chain 34 and delivered onto the delivery pile board 35.

In the present embodiment, the rotary screen cylinder 28 of the screen printing unit 20*e* is rotationally driven by a dedicated drive motor (first motor) 73 independently of the sheet-fed offset printing press driven by a prime motor (second motor) 55. The impression cylinder 27 opposing the rotary screen cylinder 28 is rotationally driven by the prime motor 55 of the sheet-fed offset printing press via a gear train, as in a conventional sheet-fed offset printing press.

During printing, the drive motor 73 is controlled in synchronization with the prime motor 55 by a drive control device (control device) 40 for the sheet-fed offset printing press (to be described later) and a drive control device (control device) 70 for the rotary screen cylinder, for example, so that a pattern-free portion (hole-free portion) in the screen printing forme and a gap portion (sheet-holding portion) of the impression cylinder 27 always oppose each other while rotating.

The drive control device 40 for the sheet-fed offset printing press and the drive control device 70 for the rotary screen cylinder start the control of the drive motor 73 so as to be synchronized with the prime motor 55 (hereinafter may be referred to as the synchronous control of the drive motor 73 with respect to the prime motor 55) when the sheet-fed offset printing press has rotated through a rotation angle set by a rotation angle setting instrument 51 (see FIG. 1A) which sets the rotation angle of the sheet-fed offset printing press from the time of supply of the sheet 1 until the start of control over the drive motor 73 for synchronization with the prime motor 55.

As shown in FIGS. 1A and 1B, the drive control device 40 for the sheet-fed offset printing press comprises CPU 41*a*, ROM 42*a*, RAM 43*a*, input/output devices 44*a* to 44*f*, and an interface 45*a* connected together by a BUS line.

To the BUS line, an internal clock counter 59*a* and the following memories are connected: A memory M1 for storing a rotation angle until start of synchronous control, a memory M2 for strong the set rotational speed of the sheet-fed offset printing press, a memory M3 for storing a low rotational speed, a memory M4 for storing the command rotational speed of the sheet-fed offset printing press, and a memory M5 for storing the output of an absolute rotary encoder for detecting the rotation phase of the sheet-fed offset printing press.

To the BUS line, the following memories are further connected: A memory M6 for storing a count value N, a memory M7 for storing the previous command rotational speed of the sheet-fed offset printing press, a memory M8 for storing the modification value of the rotational speed for speed acceleration, a memory M9 for storing the modified command rotational speed of the sheet-fed offset printing press, a memory M10 for storing a time interval for speed acceleration or reduction, and a memory M11 for storing the modification value of the rotational speed for speed reduction.

To the input/output device 44*a*, the following are connected: A drive switch 46 for the printing press, a drive stop switch 47 for the printing press, an input device 48*a* such as a keyboard, various switches and buttons, a display device 49*a* such as CRT and lamps, and an output device 50*a* such as a printer and a floppy disk (registered trademark) drive.

The aforementioned rotation angle setting instrument 51 is connected to the input/output device 44*b*, and a rotational speed setting instrument 52 for the sheet-fed offset printing press is connected to the input/output device 44*c*.

A driver 54 for the prime motor of the sheet-fed offset printing press is connected to the input/output device 44*d* via a D/A converter 53. The aforementioned prime motor 55 of the sheet-fed offset printing press, and a rotary encoder 56 for the prime motor of the sheet-fed offset printing press, which is coupled to and driven by the prime motor 55, are connected to the driver 54 for the prime motor.

An absolute rotary encoder (one-revolution detector) 57 for detecting the rotation phase of the sheet-fed offset printing press is connected to the input/output device 44*e*. The aforementioned impression throw-on sensor 58 is connected to the input/output device 44*f*. The absolute rotary encoder 57 for detecting the rotation phase of the sheet-fed offset printing press is mounted on a rotating member of the first offset printing unit 20*a*, and makes one revolution each time the first offset printing unit 20*a* makes one revolution, in other words, each time the first offset printing unit 20*a* prints the sheet 1.

The aforementioned feeder 10, a printing press control device 60, and a drive control device 70 for the rotary screen cylinder to be described later are connected to the interface 45*a*.

As shown in FIGS. 2A and 2B, the drive control device 70 for the rotary screen cylinder comprises CPU 41*b*, ROM 42*b*, RAM 43*b*, input/output devices 44*g* to 44*j*, and an interface 45*b* connected together by a BUS line.

To the BUS line, not only an internal clock counter 59*b*, but also the following memories are connected: A memory M12 for storing the output of the absolute rotary encoder for detecting the rotation phase of the sheet-fed offset printing press, a memory M13 for storing the current rotation phase of the sheet-fed offset printing press, a memory M14 for storing the previous rotation phase of the sheet-fed offset printing press, a memory M15 for storing a time interval for synchronous control, and a memory M16 for storing the latest movement in the rotation phase of the sheet-fed offset printing press.

To the BUS line, the following memories are further connected: A memory M17 for storing the current rotational speed of the sheet-fed offset printing press, a memory M18 for storing the correction value of the rotation phase of the rotary screen cylinder, a memory M19 for storing the virtual current rotation phase of the rotary screen cylinder, a memory M20 for storing the count value of a counter for detecting the rotation phase of the rotary screen cylinder, a memory M21 for storing the current rotation phase of the rotary screen cylinder, and a memory M22 for storing the current rotation phase difference of the rotary screen cylinder.

To the BUS line, the following memories are further connected: A memory M23 for storing the absolute value of the current rotation phase difference of the rotary screen cylinder, a memory M24 for storing the allowable value of the rotation phase difference of the rotary screen cylinder, a memory M25 for storing a table of conversion from the current rotation phase difference of the rotary screen cylinder to the correction value of the command rotational speed of the rotary screen cylinder, a memory M26 for storing the correction value of the command rotational speed of the rotary screen cylinder, and a memory M27 for storing the command rotational speed of the rotary screen cylinder.

To the input/output device 44*g*, the following are connected: An input device 48*b* such as a keyboard, various switches and buttons, a display device 49*b* such as CRT and lamps, and an output device 50*b* such as a printer and a floppy disk (registered trademark) drive.

A driver 72 for the drive motor of the rotary screen cylinder is connected to the input/output device 44*h* via a D/A converter 71. A drive motor 73 of the rotary screen cylinder, and a rotary encoder 74 for the drive motor of the rotary screen cylinder are connected to the driver 72 for the drive motor. The rotary encoder 74 for the drive motor of the rotary screen cylinder is directly mounted on a rear end portion of the output shaft of the drive motor 73 of the rotary screen cylinder, and makes one revolution each time the rotary screen cylinder 28 makes one revolution, in other words, each time the rotary screen cylinder 28 prints the sheet 1. At each revolution, the rotary encoder 74 outputs a zero pulse once, resetting a counter 75 for detecting the rotation phase of the rotary screen cylinder. Whenever the rotary screen cylinder 28 rotates through a predetermined angle, the rotary encoder 74 also outputs a clock pulse to the counter 75 for detecting the rotation phase of the rotary screen cylinder.

The counter 75 for detecting the rotation phase of the rotary screen cylinder is connected to the input/output device 44*i*, and the rotary encoder 74 for the drive motor of the rotary screen cylinder is connected to the counter 75.

The absolute rotary encoder 57 for detecting the rotation phase of the sheet-fed offset printing press is connected to the input/output device 44*j*. The aforementioned drive control device 40 for the sheet-fed offset printing press is connected to the interface 45*b*.

Because of the above-described features, when the rotary screen cylinder is to be controlled in synchronization with the sheet-fed offset printing press, the drive control device 40 for the sheet-fed offset printing press acts in accordance with the motion flows shown in FIGS. 3A to 3D, FIG. 4A and FIG. 4B.

In Step P1, it is determined whether the drive switch 46 for the printing press is ON. If the answer is Y (yes), a low rotational speed is loaded from the memory M3 in Step P2. If the answer is N (no), it is determined in Step P3 whether there is an input to the rotation angle setting instrument 51.

If the answer is Y in Step P3, Step P4 is executed to load a rotation angle until start of synchronous control from the rotation angle setting instrument 51, and store it into the memory M1. If the answer is N in Step P3, it is determined in Step P5 whether there is an input to the rotational speed setting instrument 52.

If the answer is Y in Step P5, Step P6 is executed to load the set rotational speed of the sheet-fed offset printing press from the rotational speed setting instrument 52, and store it into the memory M2. If the answer is N in Step P5, the program returns to Step P1.

Then, in Step P7, the low rotational speed is written into the memory M4 for storing the command rotational speed of the sheet-fed offset printing press. Then, in Step P8, the command (low) rotational speed is outputted to the driver 54 for the prime motor of the sheet-fed offset printing press.

Then, in Step P9, an output is loaded from the absolute rotary encoder 57 for detecting the rotation phase of the sheet-fed offset printing press, and stored into the memory M5. Then follows Step P10 to determine whether the output of the absolute rotary encoder for detecting the rotation phase of the sheet-fed offset printing press is zero. If the answer is Y, a sheet feed start command is transmitted to the feeder 10 in Step P11.

Then, in Step P12, it is determined whether the output of the impression throw-on sensor 58 is ON. If the answer is Y, a print start command is transmitted to the printing press control device 60 in Step P13. Then, in Step P14, the memory M6 for storing the count value N is overwritten with zero.

Then, in Step P15, an output is loaded from the absolute rotary encoder 57 for detecting the rotation phase of the sheet-fed offset printing press, and stored into the memory M5. Then follows Step P16 to determine whether the output of the absolute rotary encoder for detecting the rotation phase of the sheet-fed offset printing press is zero. If the answer is Y, the count value N is loaded from the memory M6 in Step P17.

Then, in Step P18, 1 is added to the count value N to overwrite the memory M6. Then, in Step P19, the rotation angle until start of synchronous control is loaded from the memory M1. Then, in Step P20, it is determined whether the count value N is the rotation angle until start of synchronous control. If the answer is Y, the program shifts to Step P21. If the answer is N, the program returns to Step P15.

Then, in the above-mentioned Step P21, a synchronous home position alignment start command is transmitted to the drive control device 70 for the rotary screen cylinder. Then, if a synchronous home position alignment completion command is transmitted from the drive control device 70 for the rotary screen cylinder in Step P22, the low rotational speed is loaded from the memory M3 in Step P23.

Then, in Step P24, the low rotational speed is written into the memory M7 for storing the previous command rotational speed of the sheet-fed offset printing press. Then follows Step P25 to start counting by the internal clock counter (for counting of the elapsed time) 59*a*.

Then, in Step P26, the previous command rotational speed of the sheet-fed offset printing press is loaded from the memory M7. Then follows Step P27 to load the modification value of the rotational speed for speed acceleration from the memory M8. Then, in Step P28, the modification value of the rotational speed for speed acceleration is added to the previous command rotational speed of the sheet-fed offset printing press to compute the modified command rotational speed of the sheet-fed offset printing press, which is stored into the memory M9.

Then, in Step P29, the set rotational speed of the sheet-fed offset printing press is loaded from the memory M2. Then, Step P30 is executed to determine whether the set rotational speed of the sheet-fed offset printing press is equal to or less than the modified command rotational speed of the sheet-fed offset printing press.

If the answer is Y in the above Step P30, the memory M4 for storing the command rotational speed of the sheet-fed offset printing press is overwritten with the set rotational speed of the sheet-fed offset printing press in Step P31. If the answer is N in Step P30, the program shifts to Step P34 to be described later.

Then, in Step P32, the command rotational speed is outputted to the driver 54 for the prime motor of the sheet-fed offset printing press. Then, if the drive stop switch 47 for the printing press is ON in Step P33, the program shifts to Step P41 to be described later.

Then, in the above-mentioned Step P34, the memory M4 for storing the command rotational speed of the sheet-fed offset printing press is overwritten with the modified command rotational speed of the sheet-fed offset printing press. Then, in Step P35, the time interval for speed acceleration or reduction is loaded from the memory M10. Then, in Step P36, the count value of the internal clock counter 59*a* is loaded.

Then, in Step P37, it is determined whether the count value of the internal clock counter is equal to the time interval for speed acceleration or reduction. If the answer is Y, the command rotational speed of the sheet-fed offset printing press is loaded from the memory M4 in Step P38. If the answer is N, the program returns to Step P35.

Then, in Step P39, the command rotational speed is outputted to the driver 54 for the prime motor of the sheet-fed offset printing press. Then, in Step P40, the memory M7 for storing the previous command rotational speed of the sheet-fed offset printing press is overwritten with the command rotational speed of the sheet-fed offset printing press, whereafter the program returns to Step P25.

Then, in Step P41 shifted from the aforementioned Step P33, a sheet feed stop command is transmitted to the feeder 10. Then, a print stop command is transmitted to the printing press control device 60 in Step P42. Then, in Step P43, counting by the internal clock counter (for counting of the elapsed time) 59*a* is started.

Then, in Step P44, the previous command rotational speed of the sheet-fed offset printing press is loaded from the memory M7. Then follows Step P45 to load the modification value of the rotational speed for speed reduction from the memory M11. Then, in Step P46, the modification value of the rotational speed for speed reduction is subtracted from the previous command rotational speed of the sheet-fed offset printing press to compute the modified command rotational speed of the sheet-fed offset printing press, which is stored into the memory M9.

Then, in Step P47, it is determined whether the modified command rotational speed of the sheet-fed offset printing press is lower than zero. If the answer is Y, in Step P48, the memory M4 for storing the command rotational speed of the sheet-fed offset printing press is overwritten with zero. If the answer is N, the programs shifts to Step P52.

Then, in Step P49, the command rotational speed of the sheet-fed offset printing press is loaded from the memory M4. Then, in Step P50, the command rotational speed is outputted to the driver 54 for the prime motor of the sheet-fed offset printing press. Then, in Step P51, an operation stop command is transmitted to the drive control device 70 for the rotary screen cylinder, whereafter the program return to Step P1.

Then, in the above-mentioned Step P52, the memory M4 for storing the command rotational speed of the sheet-fed offset printing press is overwritten with the modified command rotational speed of the sheet-fed offset printing press. Then, in Step P53, the time interval for speed acceleration or reduction is loaded from the memory M10.

Then, the count value of the internal clock counter 59*a* is loaded in Step P54. Then, in Step P55, it is determined whether the count value of the internal clock counter is equal to the time interval for speed acceleration or reduction.

If the answer is Y in the above Step P55, the command rotational speed of the sheet-fed offset printing press is loaded from the memory M4 in Step P56. If the answer is N in the above Step P55, the program returns to Step P53. Then, in Step P57, the command rotational speed is outputted to the driver 54 for the prime motor of the sheet-fed offset printing press. Then, in Step P58, the memory M7 for storing the previous command rotational speed of the sheet-fed offset printing press is overwritten with the command rotational speed of the sheet-fed offset printing press. Then, the program returns to Step P43.

In accordance with the foregoing motions or actions, the drive control device 40 for the sheet-fed offset printing press controls the prime motor 55 of the sheet-fed offset printing press to be driven individually.

Then, the drive control device 70 for the rotary screen cylinder acts in accordance with the motion flows shown in FIGS. 5A to 5E and FIGS. 6A to 6E.

In Step P1, it is determined whether a synchronous home position alignment start command has been transmitted from the drive control device 40 for the sheet-fed offset printing press. If the answer is Y, Step P2 is executed to load an output from the absolute rotary encoder 57 for detecting the rotation phase of the sheet-fed offset printing press, and store it into the memory M12.

Then, in Step P3, the current rotation phase of the sheet-fed offset printing press is computed from the output of the absolute rotary encoder 57 for detecting the rotation phase of the sheet-fed offset printing press, and is stored into the memory M13. Then, in Step P4, the current rotation phase of the sheet-fed offset printing press is stored into the memory M14 for storing the previous rotation phase of the sheet-fed offset printing press.

Then, in Step P5, counting by the internal clock counter (for counting of the elapsed time) 59*b* is started. Then, in Step P6, the time interval for synchronous control is loaded from the memory M15, whereafter the count value of the internal clock counter 59*b* is loaded in Step P7.

Then, in Step P8, it is determined whether the count value of the internal clock counter is equal to the time interval for synchronous control. If the answer is Y, in Step P9, the output is loaded from the absolute rotary encoder 57 for detecting the rotation phase of the sheet-fed offset printing press, and is stored into the memory M12. If the answer is N in Step P8, the program returns to Step P6.

Then, in Step P10, the current rotation phase of the sheet-fed offset printing press is computed from the output of the absolute rotary encoder 57 for detecting the rotation phase of the sheet-fed offset printing press, and is stored into the memory M13. Then follows Step P11 to load the previous rotation phase of the sheet-fed offset printing press from the memory M14.

Then, it is determined in Step P12 whether the current rotation phase of the sheet-fed offset printing press is less than the previous rotation phase of the sheet-fed offset printing press. If the answer is Y, 360° is added to the current rotation phase of the sheet-fed offset printing press in Step P13 for overwriting of the memory M13 for storing the current rotation phase of the sheet-fed offset printing press. Then, the program shifts to Step P14. If the answer is N in Step P12, the program directly shifts to Step P14.

Then, in the above Step P14, the current rotation phase of the sheet-fed offset printing press is loaded from the memory M13. Then, in Step P15, the previous rotation phase of the sheet-fed offset printing press is loaded from the memory M14. Then follows Step P16 in which the previous rotation phase of the sheet-fed offset printing press is subtracted from the current rotation phase of the sheet-fed offset printing press to compute the latest movement in the rotation phase of the sheet-fed offset printing press, which is stored into the memory M16.

Then, in Step P17, the time interval for synchronous control is loaded from the memory M15. Then follows Step P18 in which the latest movement in the rotation phase of the sheet-fed offset printing press is divided by the time interval for synchronous control to compute the current rotational speed (low speed) of the sheet-fed offset printing press, which is stored into the memory M17.

Then, in Step P19, the output of the absolute rotary encoder 57 for detecting the rotation phase of the sheet-fed offset printing press is loaded from the memory M12. Then, in Step P20, the current rotation phase of the sheet-fed offset printing press is computed from the output of the absolute rotary encoder 57 for detecting the rotation phase of the sheet-fed offset printing press, and the memory M13 is overwritten with the result of computation.

Then, in Step P21, the correction value of the rotation phase of the rotary screen cylinder is loaded from the memory M18. Then, in Step P22, the correction value of the rotation phase of the rotary screen cylinder is added to the current rotation phase of the sheet-fed offset printing press to compute the virtual current rotation phase of the rotary screen cylinder, with which the memory M19 is overwritten.

Then, in Step P23, it is determined whether the virtual current rotation phase of the rotary screen cylinder is greater than 360°. If the answer is Y, in Step P24, 360° is subtracted from the virtual current rotation phase of the rotary screen cylinder, and the memory M19 for storing the virtual current rotation phase of the rotary screen cylinder is overwritten with the resulting difference. Then, the program shifts to Step P25. If the answer is N in Step P23, the program directly shifts to Step P25.

Then, in the above Step P25, a count value is loaded from the counter 75 for detecting the rotation phase of the rotary screen cylinder, and stored into the memory M20. Then, in Step P26, the current rotation phase of the rotary screen cylinder is computed from the count value of the counter 75 for detecting the rotation phase of the rotary screen cylinder, and is stored into the memory M21.

Then, in Step P27, the virtual current rotation phase of the rotary screen cylinder is loaded from the memory M19. Then follows Step P28 to determine whether the current virtual rotation phase of the rotary screen cylinder is greater than 340°. If the answer is Y, in Step P29, the current rotation phase of the rotary screen cylinder is loaded from the memory M21. If the answer is N in Step P28, the program shifts to Step P32 to be described later.

Then, in Step P30, it is determined whether the current rotation phase of the rotary screen cylinder is less than 20°. If the answer is Y, Step P31 is executed to add 360° to the current rotation phase of the rotary screen cylinder, and overwrite the memory M21 for storing the current rotation phase of the rotary screen cylinder with the resulting sum. Then, the program shifts to the aforementioned Step P32. If the answer is N in Step P30, the program directly shifts to Step P32.

Then, in the above Step P32, the virtual current rotation phase of the rotary screen cylinder is loaded from the memory M19. Then, in Step P33, it is determined whether the current virtual rotation phase of the rotary screen cylinder is less than 20°. If the answer is Y, Step P34 is executed to load the current rotation phase of the rotary screen cylinder from the memory M21. If the answer is N in Step P33, the program shifts to Step P37 to be described later.

Then, in Step P35, it is determined whether the current rotation phase of the rotary screen cylinder is greater than 340°. If the answer is Y, Step P36 is executed to add 360° to the virtual current rotation phase of the rotary screen cylinder, and overwrite the memory M19 for storing the virtual current rotation phase of the rotary screen cylinder with the resulting sum. Then, the program shifts to the aforementioned Step P37. If the answer is N in Step P35, the program directly shifts to Step P37.

Then, in the above Step P37, the virtual current rotation phase of the rotary screen cylinder is loaded from the memory M19. Then, in Step P38, the current rotation phase of the rotary screen cylinder is loaded from the memory M21. Then follows Step P39 in which the current rotation phase of the rotary screen cylinder is subtracted from the virtual current rotation phase of the rotary screen cylinder to compute the current rotation phase difference of the rotary screen cylinder, which is stored into the memory M22.

Then, in Step P40, the absolute value of the current rotation phase difference of the rotary screen cylinder is computed from the current rotation phase difference of the rotary screen cylinder, and is stored into the memory M23. Then follows Step P41 to load the allowable value of the rotation phase difference of the rotary screen cylinder from the memory M24.

Then, in Step P42, it is determined whether the absolute value of the current rotation phase difference of the rotary screen cylinder is equal to or less than the allowable value of the rotation phase difference of the rotary screen cylinder. If the answer is Y, the current rotational speed (low speed) of the sheet-fed offset printing press is loaded from the memory M17 in Step P43. If the answer is N in Step P42, the program shifts to Step P47 to be described later.

Then, in Step P44, the memory M27 for storing the command rotational speed of the rotary screen cylinder is overwritten with the current rotational speed (low speed) of the sheet-fed offset printing press. Then, in Step P45, the command speed is outputted to the driver 72 for the drive motor of the rotary screen cylinder. Then, in Step P46, the synchronous home position alignment completion signal is transmitted to the drive control device 40 for the sheet-fed offset printing press. Then, the program shifts to Step P53 to be described later.

Then, in the aforementioned Step P47, the table of conversion from the current rotation phase difference of the rotary screen cylinder to the correction value of the command rotational speed of the rotary screen cylinder is loaded from the memory M25. Then, in Step P48, the current rotation phase difference of the rotary screen cylinder is loaded from the memory M22.

Then, in Step P49, the correction value of the command rotational speed of the rotary screen cylinder is obtained from the current rotation phase difference of the rotary screen cylinder with the use of the table of conversion from the current rotation phase difference of the rotary screen cylinder to the correction value of the command rotational speed of the rotary screen cylinder, and is stored into the memory M26. Then, the current rotational speed (low speed) of the sheet-fed offset printing press is loaded from the memory M17 in Step P50.

Then, in Step P51, the correction value of the command rotational speed of the rotary screen cylinder is added to the current rotational speed (low speed) of the sheet-fed offset printing press to compute the command rotational speed of the rotary screen cylinder, with which the memory M27 is overwritten. Then, in Step P52, the command rotational speed is outputted to the driver 72 for the drive motor of the rotary screen cylinder, whereafter the program returns to Step P5.

Then, in Step P53 shifted from the aforementioned Step P46, it is determined whether an operations top command has been transmitted from the drive control device 40 for the sheet-fed offset printing press. If the answer is Y, the program returns to Step P1. If the answer is N, the program shifts to Step P54.

Then, in the above Step P54, counting by the internal clock counter (for counting of the elapsed time) 59*b* is started. Then follows Step P55 to load the time interval for simultaneous control from the memory M15. Then, in Step P56, the count value of the internal clock counter 59*b* is loaded.

Then, in Step P57, it is determined whether the count value of the internal clock counter is equal to the time interval for simultaneous control. If the answer is Y, Step P58 is executed to load an output from the absolute rotary encoder 57 for detecting the rotation phase of the sheet-fed offset printing press, and store the output into the memory M12. If the answer is N in Step P57, the program returns to Step P55.

Then, in Step P59, the current rotation phase of the sheet-fed offset printing press is computed from the output of the absolute rotary encoder 57 for detecting the rotation phase of the sheet-fed offset printing press, and is stored into the memory M13. Then follows Step P60 to load the previous rotation phase of the sheet-fed offset printing press from the memory M14.

Then, in Step P61, it is determined whether the current rotation phase of the sheet-fed offset printing press is less than the previous rotation phase of the sheet-fed offset printing press. If the answer is Y, Step P62 is executed to add 360° to the current rotation phase of the sheet-fed offset printing press, and overwrite the memory M13 for storing the current rotation phase of the sheet-fed offset printing press with the resulting sum. Then, the program shifts to Step P63. If the answer is N in Step P61, the program directly shifts to Step P63.

Then, in the above Step P63, the current rotation phase of the sheet-fed offset printing press is loaded from the memory M13. Then, in Step P64, the previous rotation phase of the sheet-fed offset printing press is loaded from the memory M14. Then follows Step P65 in which the previous rotation phase of the sheet-fed offset printing press is subtracted from the current rotation phase of the sheet-fed offset printing press to compute the latest movement in the rotation phase of the sheet-fed offset printing press, which is stored into the memory M16.

Then, in Step P66, the time interval for simultaneous control is loaded from the memory M15. Then follows Step P67 in which the latest movement in the rotation phase of the sheet-fed offset printing press is divided by the time interval for simultaneous control to compute the current rotational speed of the sheet-fed offset printing press, which is stored into the memory M17.

Then, in Step P68, the output of the absolute rotary encoder 57 for detecting the rotation phase of the sheet-fed offset printing press is loaded from the memory M12. Then, in Step P69, the current rotation phase of the sheet-fed offset printing press is computed from the output of the absolute rotary encoder 57 for detecting the rotation phase of the sheet-fed offset printing press, and the memory M13 is overwritten with this result of computation.

Then, in Step P70, the correction value of the rotation phase of the rotary screen cylinder is loaded from the memory M18. Then, in Step P71, the correction value of the rotation phase of the rotary screen cylinder is added to the current rotation phase of the sheet-fed offset printing press to compute the virtual current rotation phase of the rotary screen cylinder, with which the memory M19 is overwritten.

Then, in Step P72, it is determined whether the virtual current rotation phase of the rotary screen cylinder is greater than 360°. If the answer is Y, in Step P73, 360° is subtracted from the virtual current rotation phase of the rotary screen cylinder, and the memory M19 for storing the virtual current rotation phase of the rotary screen cylinder is overwritten with the resulting difference. Then, the program shifts to Step P74. If the answer is N in Step P72, the program directly shifts to Step P74.

Then, in the above Step P74, a count value is loaded from the counter 75 for detecting the rotation phase of the rotary screen cylinder, and stored into the memory M20. Then, in Step P75, the current rotation phase of the rotary screen cylinder is computed from the count value of the counter 75 for detecting the rotation phase of the rotary screen cylinder, and is stored into the memory M21.

Then, in Step P76, the virtual current rotation phase of the rotary screen cylinder is loaded from the memory M19. Then follows Step P77 to determine whether the current virtual rotation phase of the rotary screen cylinder is greater than 340°. If the answer is Y, in Step P78, the current rotation phase of the rotary screen cylinder is loaded from the memory M21. If the answer is N in Step P77, the program shifts to Step P81 to be described later.

Then, in Step P79, it is determined whether the current rotation phase of the rotary screen cylinder is less than 20°. If the answer is Y, Step P80 is executed to add 360° to the current rotation phase of the rotary screen cylinder, and overwrite the memory M21 for storing the current rotation phase of the rotary screen cylinder with the resulting sum. Then, the program shifts to the aforementioned Step P81. If the answer is N in Step P79, the program directly shifts to Step P81.

Then, in the above Step P81, the virtual current rotation phase of the rotary screen cylinder is loaded from the memory M19. Then, in Step P82, it is determined whether the current virtual rotation phase of the rotary screen cylinder is less than 20°. If the answer is Y, Step P83 is executed to load the current rotation phase of the rotary screen cylinder from the memory M21. If the answer is N in Step P82, the program shifts to Step P86 to be described later.

Then, in Step P84, it is determined whether the current rotation phase of the rotary screen cylinder is greater than 340°. If the answer is Y, Step P85 is executed to add 360° to the virtual current rotation phase of the rotary screen cylinder, and overwrite the memory M19 for storing the virtual current rotation phase of the rotary screen cylinder with the resulting sum. Then, the program shifts to the aforementioned Step P86. If the answer is N in Step P84, the program directly shifts to Step P86.

Then, in the above Step P86, the virtual current rotation phase of the rotary screen cylinder is loaded from the memory M19. Then, in Step P87, the current rotation phase of the rotary screen cylinder is loaded from the memory M21. Then follows Step P88 in which the current rotation phase of the rotary screen cylinder is subtracted from the virtual current rotation phase of the rotary screen cylinder to compute the current rotation phase difference of the rotary screen cylinder, which is stored into the memory M22.

Then, in Step P89, the absolute value of the current rotation phase difference of the rotary screen cylinder is computed from the current rotation phase difference of the rotary screen cylinder, and is stored into the memory M23. Then follows Step P90 to load the allowable value of the rotation phase difference of the rotary screen cylinder from the memory M24.

Then, in Step P91, it is determined whether the absolute value of the current rotation phase difference of the rotary screen cylinder is equal to or less than the allowable value of the rotation phase difference of the rotary screen cylinder. If the answer is Y, the current rotational speed of the sheet-fed offset printing press is loaded from the memory M17 in Step P92. If the answer is N in Step P91, the program shifts to Step P96 to be described later.

Then, in Step P93, the memory M27 for storing the command rotational speed of the rotary screen cylinder is overwritten with the current rotational speed of the sheet-fed offset printing press. Then, in Step P94, the command rotational speed is outputted to the driver 72 for the drive motor of the rotary screen cylinder. Then, the program returns to Step P53.

Then, in the aforementioned Step P96, the table of conversion from the current rotation phase difference of the rotary screen cylinder to the correction value of the command rotational speed of the rotary screen cylinder is loaded from the memory M25. Then, in Step P97, the current rotation phase difference of the rotary screen cylinder is loaded from the memory M22.

Then, in Step P98, the correction value of the command rotational speed of the rotary screen cylinder is obtained from the current rotation phase difference of the rotary screen cylinder with the use of the table of conversion from the current rotation phase difference of the rotary screen cylinder to the correction value of the command rotational speed of the rotary screen cylinder, and is stored into the memory M26. Then, the current rotational speed of the sheet-fed offset printing press is loaded from the memory M17 in Step P99.

Then, in Step P100, the correction value of the command rotational speed of the rotary screen cylinder is added to the current rotational speed of the sheet-fed offset printing press to compute the command rotational speed of the rotary screen cylinder, with which the memory M27 is overwritten. Then, in Step P101, the command rotational speed is outputted to the driver 72 for the drive motor of the rotary screen cylinder, whereafter the program returns to Step P53.

In accordance with the above-described motions, the drive control device 70 for the rotary screen cylinder individually drives the drive motor 73 of the rotary screen cylinder 28, and during printing, drives the drive motor 73 in synchronization with the prime motor 55 of the sheet-fed offset printing press.

In the present embodiment, according to the drive control device 40 for the sheet-fed offset printing press and the drive control device 70 for the rotary screen cylinder, the first sheet 1 supplied is detected by the impression throw-on sensor 58. The rotation angle of the sheet-fed offset printing press from the time of supply of the sheet 1 until start of synchronous control of the drive motor 73 with respect to the prime motor 55 is set by the rotation angle setting instrument 51. When the sheet-fed offset printing press is rotated through the set rotation angle, the synchronous control of the drive motor 73 with respect to the prime motor 55 is started. Until that time, the rotation of the rotary screen cylinder 28 is stopped.

As described above, control over the drive motor 73 for synchronization with the prime motor 55 is started in timing for the supply of the sheet 1 to the rotary screen cylinder 28. Thus, the staining of the surroundings with unnecessary ink or the deterioration of printing quality can be prevented.

It goes without saying that the present invention is not limited to the above embodiment, and various changes and modifications may be made without departing from the gist of the present invention. In the present embodiment, for example, in order to detect the rotation phase of the sheet-fed offset printing press, the absolute rotary encoder 57 is allowed to function as a one-revolution detector, and the number of times the absolute rotary encoder 57 has detected that the sheet-fed offset printing press has made one revolution is counted. When the counted number equals the number set by the rotation angle setting instrument 51, the aforementioned synchronous control is started. However, the rotation phase of the sheet-fed offset printing press may be detected in a certain rotation angle unit and, when the sum of the rotation angles equals the rotation angle set by the rotation angle setting instrument, synchronous control may be started. Such variations are not to be regarded as a departure from the spirit and scope of the invention, and all such modifications as would be obvious to one skilled in the art are intended to be included within the scope of the following claims.

INDUSTRIAL APPLICABILITY

The present invention is useful when applied to a synchronous control method and apparatus for a rotary stencil printing press equipped with a rotary screen printing unit, and a processing unit for performing processing other than stencil printing, such as an offset printing unit.

REFERENCE SIGNS LIST

1 Sheet
10 Feeder
20 Printing unit
30 Delivery unit
20*a* to 20*d* First to fourth offset printing units (rotary stencil printing press equipped with a processing unit for performing processing other than stencil printing)
20*e* Screen printing unit (rotary stencil printing press equipped with a stencil printing plate cylinder)
28 Rotary screen cylinder (stencil printing plate cylinder)
40 Drive control device (control device) for sheet-fed offset printing press
51 Rotation angle setting instrument
55 Prime motor (second motor) of sheet-fed offset printing press
57 Absolute rotary encoder (one-revolution detector) for detecting rotation phase of sheet-fed offset printing press
58 Impression throw-on sensor (detector)
60 Printing press control device
70 Drive control device (control device) for rotary screen cylinder
73 Drive motor (first motor) of rotary screen cylinder

CITATION LIST

Patent Literature

Patent Document 1: JP-A-2008-120064

The invention claimed is:

1. A synchronous control method for a rotary stencil printing press including
a stencil printing plate cylinder for holding a stencil printing plate and transferring ink stored within the stencil printing plate cylinder through holes of the stencil printing plate to perform printing, and
a processing unit for performing processing other than stencil printing,
the synchronous control method comprising:
providing a first motor for rotationally driving the stencil printing plate cylinder,
a second motor for rotationally driving the processing unit, and
a rotation angle setting instrument for setting a rotation angle of the second motor from a time when a material to be printed is supplied until synchronous control of the first motor with respect to the second motor is started; and
starting the synchronous control of the first motor with respect to the second motor when the processing unit rotates through the rotation angle set by the rotation angle setting instrument after the material to be printed is supplied.

2. The synchronous control method for a rotary stencil printing press according to claim 1, further comprising:
providing a detector for detecting that the material to be printed has been supplied; and
starting the synchronous control of the first motor with respect to the second motor when the processing unit rotates through the rotation angle set by the rotation angle setting instrument after the detector detects the material to be printed.

3. The synchronous control method for a rotary stencil printing press according to claim 1, further comprising:
providing a detector for detecting that the material to be printed has been supplied, and
a one-revolution detector for detecting one revolution of the processing unit each time the processing unit makes the one revolution;
counting a number of times the one-revolution detector has detected that the processing unit has made the one revolution after the detector detects the material to be printed; and
starting the synchronous control of the first motor with respect to the second motor when the number of time counted in the counting step equals a number set by the rotation angle setting instrument.

4. A synchronous control apparatus for a rotary stencil printing press including
a stencil printing plate cylinder for holding a stencil printing plate and transferring ink stored within the stencil printing plate cylinder through holes of the stencil printing plate to perform printing, and
a processing unit for performing processing other than stencil printing,
the synchronous control apparatus comprising:
a first motor for rotationally driving the stencil printing plate cylinder;
a second motor for rotationally driving the processing unit;
a rotation angle setting instrument for setting a rotation angle of the second motor from a time when a material to be printed is supplied until synchronous control of the first motor with respect to the second motor is started; and
a control device for starting the synchronous control of the first motor with respect to the second motor when the processing unit rotates through the rotation angle set by the rotation angle setting instrument after the material to be printed is supplied.

5. The synchronous control apparatus for a rotary stencil printing press according to claim 4,
further comprising
a detector for detecting that the material to be printed has been supplied, and
wherein the control device starts the synchronous control of the first motor with respect to the second motor when the processing unit rotates through the rotation angle set by the rotation angle setting instrument after the detector detects the material to be printed.

6. The synchronous control apparatus for a rotary stencil printing press according to claim 4,
further comprising
a detector for detecting that the material to be printed has been supplied, and
a one-revolution detector for detecting one revolution of the processing unit each time the processing unit makes the one revolution, and
wherein the control device
counts a number of times the one-revolution detector has detected that the processing unit has made the one revolution after the detector detects the material to be printed, and
starts the synchronous control of the first motor with respect to the second motor when the number counted by the one-revolution detector equals a number set by the rotation angle setting instrument.

7. The synchronous control apparatus for a rotary stencil printing press according to claim 4, wherein
the stencil printing plate is a screen printing form.

* * * * *